US009129544B2

(12) United States Patent
Saitoh et al.

(10) Patent No.: US 9,129,544 B2
(45) Date of Patent: Sep. 8, 2015

(54) DISPLAY DEVICE, AND METHOD FOR DRIVING DISPLAY DEVICE

(75) Inventors: Kohji Saitoh, Osaka (JP); Masaki Uehata, Osaka (JP); Masami Ozaki, Osaka (JP); Toshihiro Yanagi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/009,187

(22) PCT Filed: Apr. 4, 2012

(86) PCT No.: PCT/JP2012/059195

§ 371 (c)(1),
(2), (4) Date: Oct. 1, 2013

(87) PCT Pub. No.: WO2012/137817

PCT Pub. Date: Oct. 11, 2012

(65) Prior Publication Data

US 2014/0028654 A1 Jan. 30, 2014

(30) Foreign Application Priority Data

Apr. 8, 2011 (JP) ..... 2011-086815

(51) Int. Cl.
*G09G 3/36* (2006.01)
*G09G 5/00* (2006.01)
*G09G 3/20* (2006.01)

(52) U.S. Cl.
CPC .. *G09G 5/00* (2013.01); *G09G 3/20* (2013.01); *G09G 3/36* (2013.01); *G09G 3/3648* (2013.01); *G09G 2300/0426* (2013.01); *G09G 2300/08* (2013.01); *G09G 2330/021* (2013.01)

(58) Field of Classification Search
CPC ..... G02F 1/1345; G09G 3/36
USPC ..... 345/211–214, 87–100, 204
See application file for complete search history.

(56) References Cited

U.S. PATENT DOCUMENTS

| | | | | |
|---|---|---|---|---|
| 7,321,353 | B2 * | 1/2008 | Tsuda et al. | 345/99 |
| 7,924,276 | B2 * | 4/2011 | Tsuda et al. | 345/213 |
| 2002/0180673 | A1 * | 12/2002 | Tsuda et al. | 345/87 |

FOREIGN PATENT DOCUMENTS

| | | | |
|---|---|---|---|
| CN | 1797141 | A | 7/2006 |
| JP | 2001-312253 | A | 11/2001 |
| WO | 01/84226 | A1 | 11/2001 |
| WO | 2008/075480 | A1 | 6/2008 |

OTHER PUBLICATIONS

Official Communication issued in International Patent Application No. PCT/JP2012/059195, mailed on Jul. 10, 2012.

* cited by examiner

*Primary Examiner* — Olga Merkoulova
(74) *Attorney, Agent, or Firm* — Keating & Bennett, LLP

(57) ABSTRACT

In order to provide a display device and a method for driving a display device, each of which is capable of repairing a disconnection in a data signal line and further reduces electric power consumption, a display device (1) includes a repair amplifier control section (14) for causing a repair amplifier circuit (12) to operate at a low-performance level during any period within a period from when scanning of pixels in the display area in the display device (1) is finished to when next scanning is started.

12 Claims, 15 Drawing Sheets

DISPLAY DEVICE, AND METHOD FOR DRIVING DISPLAY DEVICE

TECHNICAL FIELD

The present invention relates to a display device and a method for driving a display device, each of which is capable of repairing a disconnection in a data signal line.

BACKGROUND ART

In recent years, thin, lightweight, and low-power-consumption display devices, such as a liquid crystal display device, have been used in various applications. Many of these devices have a display size conformable to VGA (Video Graphic Array) standard or larger. Under such circumstances, a common object of these display devices is to reduce electric power consumption.

Patent Literature 1 discloses a method for driving a display device which achieves power saving by providing a suspension period during which no scanning signal lines are scanned. The suspension period is a non-scanning period, which is longer than a scanning period that is taken to scan a screen once.

There is also known a technique of, in the display device, repairing a disconnection in a data signal line run from a signal line drive circuit, with use of spare wires and a repair amplifier. FIG. 13 illustrates an example of the technique.

A display device 100 illustrated in FIG. 13 includes a signal line drive circuit 103 which includes a source amplifier circuit 102 connected with a plurality of data signal lines 101.

The display device 100 further includes, in an area outside its display area, two spare wires 104 and 105 each of which intersects the data signal lines 101. The spare wire 104 is provided on a signal line drive circuit 103 side of the display area of the display device 100. The spare wire 105 is provided on a side opposite to the signal line drive circuit 103 side of the display area of the display device 100.

The display device 100 further includes a repair amplifier circuit 106, which is provided in the signal line drive circuit 103. The repair amplifier circuit 106 has an input terminal connected to the spare wire 104 and an output terminal connected to the spare wire 105.

Note that the display device 100 includes two sets each consisting of the data signal lines 101, the source amplifier circuit 102, the signal line drive circuit 103, the spare wire 104, the spare wire 105, and the repair amplifier circuit 106.

FIG. 14 shows how the display device 100 repairs a disconnection in a data signal line 101. Note that, in the following description, the data signal line 101 having the disconnection is referred to as a data signal line 101*a*.

The data signal line 101*a* is connected with the spare wire 104 and the spare wire 105 such that a disconnection 107 in the data signal line 101*a* lies between a position where the spare wire 104 is connected to the data signal line 101*a* and a position where the spare wire 105 is connected to the data signal line 101*a*. Specifically, the spare wire 104 is connected to the data signal line 101*a* at a connection point 108 in a portion of the data signal line 101*a* which portion is closer to the signal line drive circuit 103 than the disconnection 107 is. On the other hand, the spare wire 105 is connected to the data signal line 101*a* at a connection point 109 in a portion of the data signal line 101*a* which portion is farther away from the signal line drive circuit 103 than the disconnection 107 is.

The source amplifier circuit 102 supplies, to the plurality of data signal lines 101, data signals for a display carried out in the display device 100.

Note, here, that a data signal supplied to the data signal line 101*a* is also supplied to the repair amplifier circuit 106 via the spare wire 104 connected to the data signal line 101*a*. The data signal supplied to the repair amplifier circuit 106 is amplified by the repair amplifier circuit 106 and supplied to the data signal line 101*a* via the spare wire 105 connected to the data signal line 101*a*.

The portion of the data signal line 101*a*, which portion is closer to the signal line drive circuit 103 than the disconnection 107 is, receives the data signal from the source amplifier circuit 102. On the other hand, the portion of the data signal line 101*a*, which portion is farther away from the signal line drive circuit 103 than the disconnection 107 is, receives a signal from the repair amplifier circuit 106.

In the display device 100 configured like above, the data signal line 101*a*, which has the disconnection, receives signals from the source amplifier circuit 102 at its opposite ends between which there is the disconnection 107. This makes it possible to repair the disconnection.

FIG. 15 illustrates a specific example of an arrangement of the display device 100 which includes the spare wire 104, the spare wire 105, and the repair amplifier circuit 106.

Each set consisting of the spare wires 104 and 105 and the repair amplifier circuit 106 is capable of repairing a disconnection in one (1) data signal line 101*a*. Therefore, in order to repair disconnections in a plurality of data signal lines 101*a*, the display device 100 in practice includes two or more sets each consisting of the spare wires 104 and 105 and the repair amplifier circuit 106.

CITATION LIST

Patent Literature

Patent Literature 1

Japanese Patent Application Publication, Tokukai No. 2001-312253 A (Publication Date: Nov. 9, 2001)

SUMMARY OF INVENTION

Technical Problem

However, the display device 100 is not so power-saving because of electric power consumed by the repair amplifier circuit 106.

In addition, the display device described in Patent Literature 1 does not at all employ the technique of repairing a disconnection.

The present invention has been accomplished in view of the foregoing problems, and an object of the present invention is to provide a display device and a method for driving a display device, each of which is capable of repairing a disconnection in a signal line and further reduces electric power consumption.

Solution to Problem

In order to attain the above object, a display device of the present invention includes: a data signal line for supplying, to a display area, a signal necessary for display; a first wire connectable to the data signal line, the first wire being provided on a first side of the display area on which first side the data signal line receives the signal; a second wire connectable to the data signal line, the second wire being provided on a second side of the display area which second side is opposite to the first side; an amplifier circuit which has an input terminal connected to the first wire and an output terminal connected to the second wire; and performance controlling means for causing the amplifier circuit to operate at a low-performance level during any period within a period from when scanning of pixels in the display area is finished to when next scanning is started.

In order to attain the above object, a method for driving a display device of the present invention is a method for driving a display device which includes: a data signal line for supplying, to a display area, a signal necessary for display; a first wire connectable to the data signal line, the first wire being provided on a first side of the display area on which first side the data signal line receives the signal; a second wire connectable to the data signal line, the second wire being provided on a second side of the display area which second side is opposite to the first side; an amplifier circuit which has an input terminal connected to the first wire and an output terminal connected to the second wire, said method comprising the step of: causing the amplifier circuit to operate at a low-performance level during any period within a period from when scanning of pixels in the display area is finished to when next scanning is started.

According to the arrangement, it is possible to achieve the following principle by connecting the first wire and the second wire to one (1) data signal line. That is, a signal inputted to the data signal line is also supplied to the amplifier circuit via the first wire, and is amplified by the amplifier circuit. The signal amplified by the amplifier circuit is supplied, via the second wire, to the data signal line on a side of the display area which side is opposite to the side where the signal is inputted to the data signal line.

This principle is the same as the principle as described earlier, i.e., the principle of repairing a disconnection in a data signal line with use of the two spare wires (the first wire and the second wire) and the repair amplifier circuit (amplifier circuit).

According to the arrangement, the amplifier circuit operates at a low-performance level during any period within a period (i.e., non-scanning period) from when scanning of pixels in the display area is finished to when next scanning is started. This makes it possible to reduce electric power consumed by the amplifier circuit during a period during which the amplifier circuit operates at a low-performance level.

Accordingly, it is possible to further reduce the electric power consumed by a display device capable of repairing a disconnection in a data signal line.

Advantageous Effects of Invention

As described above, a display device of the present invention includes: a data signal line for supplying, to a display area, a signal necessary for display; a first wire connectable to the data signal line, the first wire being provided on a first side of the display area on which first side the data signal line receives the signal; a second wire connectable to the data signal line, the second wire being provided on a second side of the display area which second side is opposite to the first side; an amplifier circuit which has an input terminal connected to the first wire and an output terminal connected to the second wire; and performance controlling means for causing the amplifier circuit to operate at a low-performance level during any period within a period from when scanning of pixels in the display area is finished to when next scanning is started.

A method for driving a display device of the present invention is a method for driving a display device including: a data signal line for supplying, to a display area, a signal necessary for display; a first wire connectable to the data signal line, the first wire being provided on a first side of the display area on which first side the data signal line receives the signal; a second wire connectable to the data signal line, the second wire being provided on a second side of the display area which second side is opposite to the first side; an amplifier circuit which has an input terminal connected to the first wire and an output terminal connected to the second wire, said method comprising the step of: causing the amplifier circuit to operate at a low-performance level during any period within a period from when scanning of pixels in the display area is finished to when next scanning is started.

Accordingly, it is possible to further reduce the electric power consumed by the display device capable of repairing a disconnection in a signal line.

DESCRIPTION OF EMBODIMENTS

Figure 5:
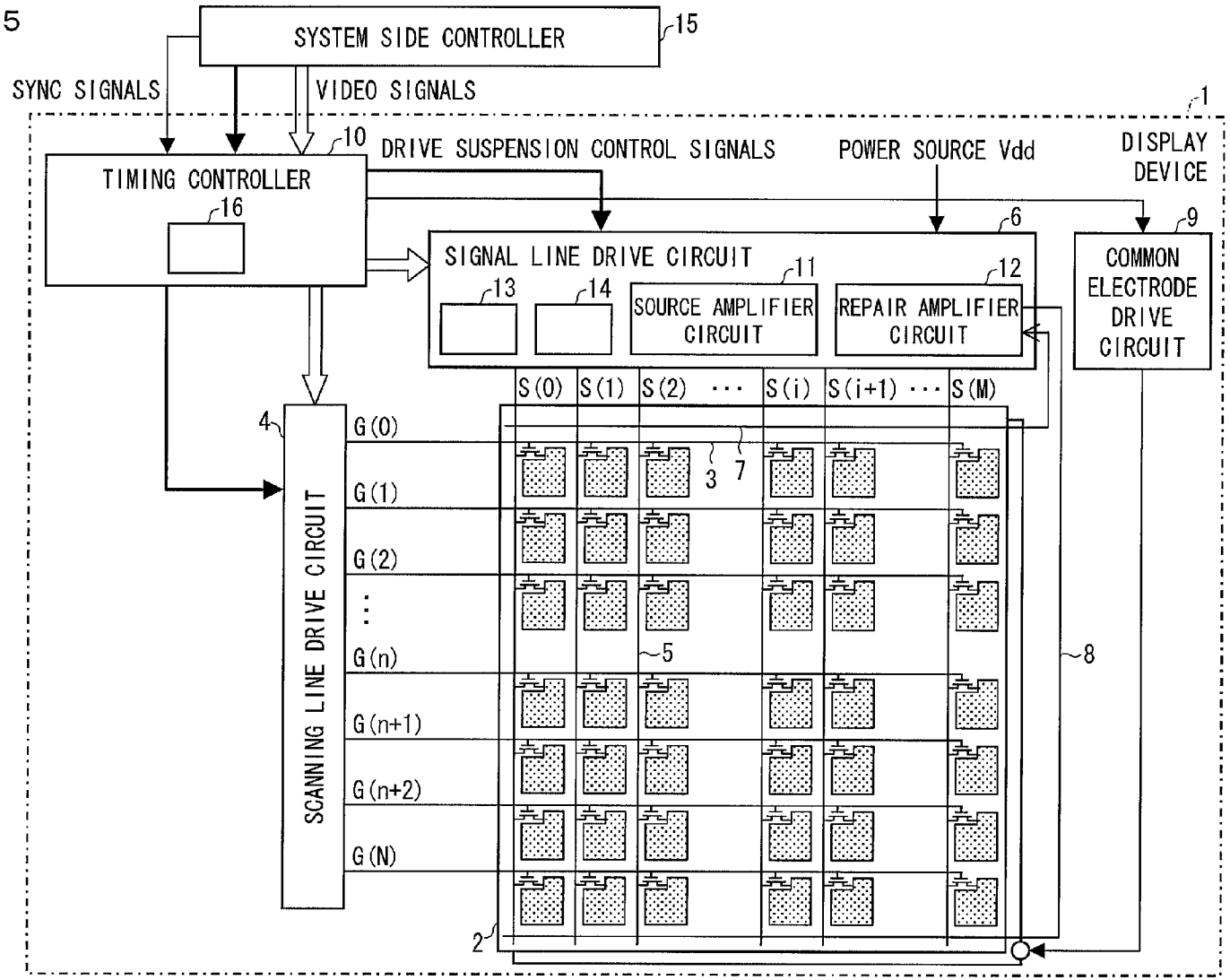
FIG. 5 is a view schematically illustrating an arrangement of a display device in accordance with one embodiment of the present invention.

FIG. 5 is a view schematically illustrating a display device 1 in accordance with the present embodiment.

The display device 1 includes a display panel 2, scanning signal lines 3, a scanning line drive circuit 4, data signal lines 5, a signal line drive circuit 6, a spare wire (first wire) 7, a spare wire (second wire) 8, a common electrode drive circuit 9, and a timing controller 10.

The signal line drive circuit 6 includes a source amplifier circuit (data signal generating circuit) 11, a repair amplifier circuit (amplifier circuit) 12, a source amplifier control section (data signal generation ability controlling means) 13, and a repair amplifier control section (performance controlling means) 14. The timing controller 10 includes a drive suspension control section 16. The display device 1 is connected to a system-side control section 15.

The display panel 2 includes (i) a screen in which a plurality of pixels are provided in a matrix pattern, (ii) the scanning signal lines 3 for scanning the screen by line-sequential selection, and (iii) the data signal lines 5 for supplying data signals to pixels in one selected line (row). The number of the scanning signal lines 3, which are also called gate lines, is N+1 (N is an integer). The number of the data signal lines 5, which are also called source lines, is M+1 (M is an integer). The scanning signal lines 3 and the data signal lines 5 intersect each other.

G(n) (n is an integer) shown in FIG. 5 indicates the n+1th scanning signal line 3. For example, G(0) indicates the first scanning signal line 3, G(1) indicates the second scanning signal line 3, and G(2) indicates the third scanning signal line 3.

Meanwhile, S(i) (i is an integer) shown in FIG. 5 indicates the i+1th data signal line 5. For example, S(0) indicates the first data signal line 5, S(1) indicates the second data signal line 5, and S(2) indicates the third data signal line 5.

The scanning line drive circuit 4 line-sequentially scans the scanning signal lines 3 from top to bottom of the screen. Furthermore, the scanning line drive circuit 4 supplies, to each of the scanning signal lines 3, a rectangular wave for turning on a switching element (TFT: Thin Film Transistor) included in a pixel and connected to a pixel electrode. This causes pixels in one row in the screen to be placed in a selected state.

The signal line drive circuit 6 finds, from a video signal that it received via the timing controller 10, a voltage to be supplied to each of the pixels in one selected row, and supplies, to each of the data signal lines 5, the voltage as a data signal necessary for a display carried out in the display device 1. In this way, the signal line drive circuit 6 supplies image data to pixels corresponding to a selected scanning signal line 3.

The display device 1 includes a common electrode (not illustrated) provided for pixels in the screen. The common electrode drive circuit 9 supplies, to the common electrode, a predetermined common voltage for driving the common electrode, in accordance with a signal supplied from the timing controller 10.

The timing controller 10 receives (i) video sync signals such as a horizontal sync signal Hsync and a vertical sync signal Vsync to and (ii) a clock and a video signal. In accordance with the horizontal sync signal Hsync, the vertical sync signal Vsync, the clock, and the video signal, the timing controller 10 supplies, to each of the circuits, a signal serving as a reference for causing the circuits to operate in sync with each other.

Specifically, the timing controller 10 supplies, to the scanning line drive circuit 4, a gate start pulse signal, a gate clock signal, and a gate output enable signal. Furthermore, the timing controller 10 supplies, to the signal line drive circuit 6, a source start pulse signal, a source latch strobe signal, a source clock signal, and a video signal corresponding to an input image.

The scanning line drive circuit 4 starts scanning the display panel 2 in response to the gate start pulse signal received from the timing controller 10, and sequentially applies selection voltages to the scanning signal lines 3 in accordance with the gate clock signal.

Based on the source start pulse signal received from the timing controller 10, the signal line drive circuit 6 stores, in a register, image data for each pixel which data has been supplied thereto, in accordance with the source clock signal. Then, the signal line drive circuit 6 writes the image data to each of the data signal lines 5 in the display panel 2 in accordance with a subsequent source latch strobe signal.

Each of the spare wires 7 and 8 is a wire provided outside a display area (area in which a display is carried out) of the display device 1 so as to be connectable to the data signal lines 5. Specifically, each of the spare wires 7 and 8 is provided so as to intersect the data signal lines 5.

More specifically, the spare wire 7 is provided, so as to intersect the data signal lines 5, on a signal line drive circuit 6 side of the display area on which side the data signal lines 5 receive data signals. On the other hand, the spare wire 8 is provided, so as to intersect the data signal lines 5, on a side of the display area which side is opposite to the signal line drive circuit 6 side.

The source amplifier circuit 11 is constituted by, for example, M+1 analog amplifiers which correspond to the respective data signal lines 5. Alternatively, the source amplifier circuit 11 can be constituted by, for example, a plurality of analog amplifiers (for example, 256 analog amplifiers) which are provided for respective gray scale levels of the display device 1. The source amplifier circuit 11 is capable of generating data signals to be supplied to the data signal lines 5 and supplying the data signals thus generated to the data signal lines 5.

In a case where the spare wire 7 and the spare wire 8 are connected to a target data signal line 5, the source amplifier circuit 11 is capable of causing a data signal, which is supplied to the target data signal line 5, to be supplied also to the repair amplifier circuit 12 via the spare wire 7.

The repair amplifier circuit 12 has an input terminal connected to the spare wire 7 and an output terminal connected to the spare wire 8. The repair amplifier circuit 12 amplifies the data signal received via the spare wire 7, and outputs it to the spare wire 8. The repair amplifier circuit 12 is constituted by a common amplifier.

The source amplifier control section 13 is configured to reduce the source amplifier circuit 11's ability (performance) to amplify a signal voltage. Note that the source amplifier control section 13 may suspend operation of the source amplifier circuit 11. The source amplifier control section 13 is configured to also cause the source amplifier circuit 11, which is operating at a low-performance level or whose operation is suspended, to return to a normal operation state in which the performance of the source amplifier circuit 11 is not reduced. Note that the "suspension of operation" means a state in which the circuit's ability to amplify the signal voltage is reduced to the lowest level (i.e., state in which the circuit is not operating).

For example, the source amplifier control section 13 receives a second drive suspension control signal from the drive suspension control section 16 included in the timing controller 10. In a case where the second drive suspension control signal thus received indicates the normal operation of the source amplifier circuit 11, the source amplifier control section 13 causes the source amplifier circuit 11 to carry out the normal operation by, for example, supplying a H (high) level signal to the source amplifier circuit 11. On the other hand, in a case where the second drive suspension control signal thus received indicates a low-performance state of the source amplifier circuit 11, the source amplifier control section 13 causes the source amplifier circuit 11 to have a low ability to amplify the signal voltage which is lower than that in the case of the normal operation by, for example, supplying a L (low) level signal to the source amplifier circuit 11.

The repair amplifier control section 14 is configured to reduce the repair amplifier circuit 12's ability (performance) to amplify a signal voltage. Note that the repair amplifier control section 14 may suspend operation of the repair amplifier circuit 12. The repair amplifier control section 14 is configured to also cause the repair amplifier circuit 12, which is operating at a low-performance level or whose operation is suspended, to return to a normal operation state in which the performance of the repair amplifier circuit 12 is not reduced.

For example, the repair amplifier control section 14 receives a first drive suspension control signal from the drive suspension control section 16 included in the timing controller 10. In a case where the first drive suspension control signal thus received indicates the normal operation of the repair amplifier circuit 12, the repair amplifier control section 14 causes the repair amplifier circuit 12 to carry out the normal operation by, for example, supplying a H level signal to the repair amplifier circuit 12. On the other hand, in a case where the first drive suspension control signal thus received indicates the low-performance operation of the repair amplifier circuit 12, the repair amplifier control section 14 causes the repair amplifier circuit 12 to have a low ability to amplify the signal voltage which is lower than that in the case of the normal operation by, for example, supplying a L (low) level signal to the repair amplifier circuit 12.

In FIG. 5, the first drive suspension control signal and the second drive suspension control signal are collectively referred to as a drive suspension control signal.

The drive suspension control section 16 generates, in accordance with predetermined information indicative of whether or not to reduce the performance of the source amplifier circuit 11 or predetermined information indicative of a period during which the performance of the source amplifier circuit 11 is to be reduced, the second drive suspension control signal in synchronization with the video sync signals (the horizontal sync signals Hsync and/or the vertical sync signals Vsync) which are supplied to the timing controller 10. The drive suspension control section 16 supplies the second drive suspension control signal thus generated to the source amplifier control section 13.

Furthermore, the drive suspension control section 16 generates, in accordance with predetermined information indicative of whether or not to reduce the performance of the repair amplifier circuit 12 or predetermined information indicative of a period during which the performance of the repair amplifier circuit 12 is to be reduced, the first drive suspension control signal in synchronization with the video sync signals which are supplied to the timing controller 10. The drive suspension control section 16 supplies the first drive suspension control signal thus generated to the repair amplifier control section 14.

A timing of when the source amplifier control section 13 reduces the performance of the source amplifier circuit 11 and a timing of when the repair amplifier control section 14 reduces the performance of the repair amplifier circuit 12 will be described later. Also, a timing of when the source amplifier control section 13 causes the low-performance state of the source amplifier circuit 11 to end and a timing of when the repair amplifier control section 14 causes the low-performance state of the repair amplifier circuit 12 to end will be described later.

The display device 1 is also capable of repairing a disconnection in a data signal line 5 with use of the spare wires 7 and 8 and the repair amplifier circuit 12. Note that, in the following description, a data signal line 5 having a disconnection is referred to as a data signal line 5*a*.

The data signal line 5*a* is connected with the spare wire 7 and the spare wire 8 such that a disconnection 17 in the data signal line 5*a* lies between a position where the spare wire 7 is connected to the data signal line 5*a* and a position where the spare wire 8 is connected to the data signal line 5*a*. Specifically, the spare wire 7 is connected to the data signal line 5*a* at a connection point 18 on a signal line drive circuit 6 side of the display area (i.e., at the connection point 18 which is close to the signal line drive circuit 6). On the other hand, the spare wire 8 is connected to the data signal line 5*a* at a connection point 19 on a side of the display area which side is opposite to the signal line drive circuit 6 side (i.e., at the connection point 19 which is distant from the signal line drive circuit 6).

The source amplifier circuit 11 supplies, to the data signal lines 5, data signals according to which the display device 1 carries out a display.

Note here that a data signal supplied to the data signal line 5*a* is also supplied to the repair amplifier circuit 12 via the spare wire 7 connected to the data signal line 5*a*. The data signal thus supplied to the repair amplifier circuit 12 is amplified by the repair amplifier circuit 12 and is supplied to the data signal line 5*a* via the spare wire 8 connected to the data signal line 5*a*.

Assume that the data signal line 5*a* is divided into two parts by the disconnection 17. One of the parts which is on the signal line drive circuit 6 side is supplied with the data signal from the source amplifier circuit 11. The other of the parts which is on the side opposite to the signal line drive circuit 6 side is supplied with a signal from the repair amplifier circuit 12.

With this arrangement, the display device 1 is capable of supplying, to opposite ends of the data signal line 5*a* between which there is the disconnection 17, respective signals which are equivalent to signals outputted from the source amplifier circuit 11. This makes it possible to repair the disconnection.

Figure 13:
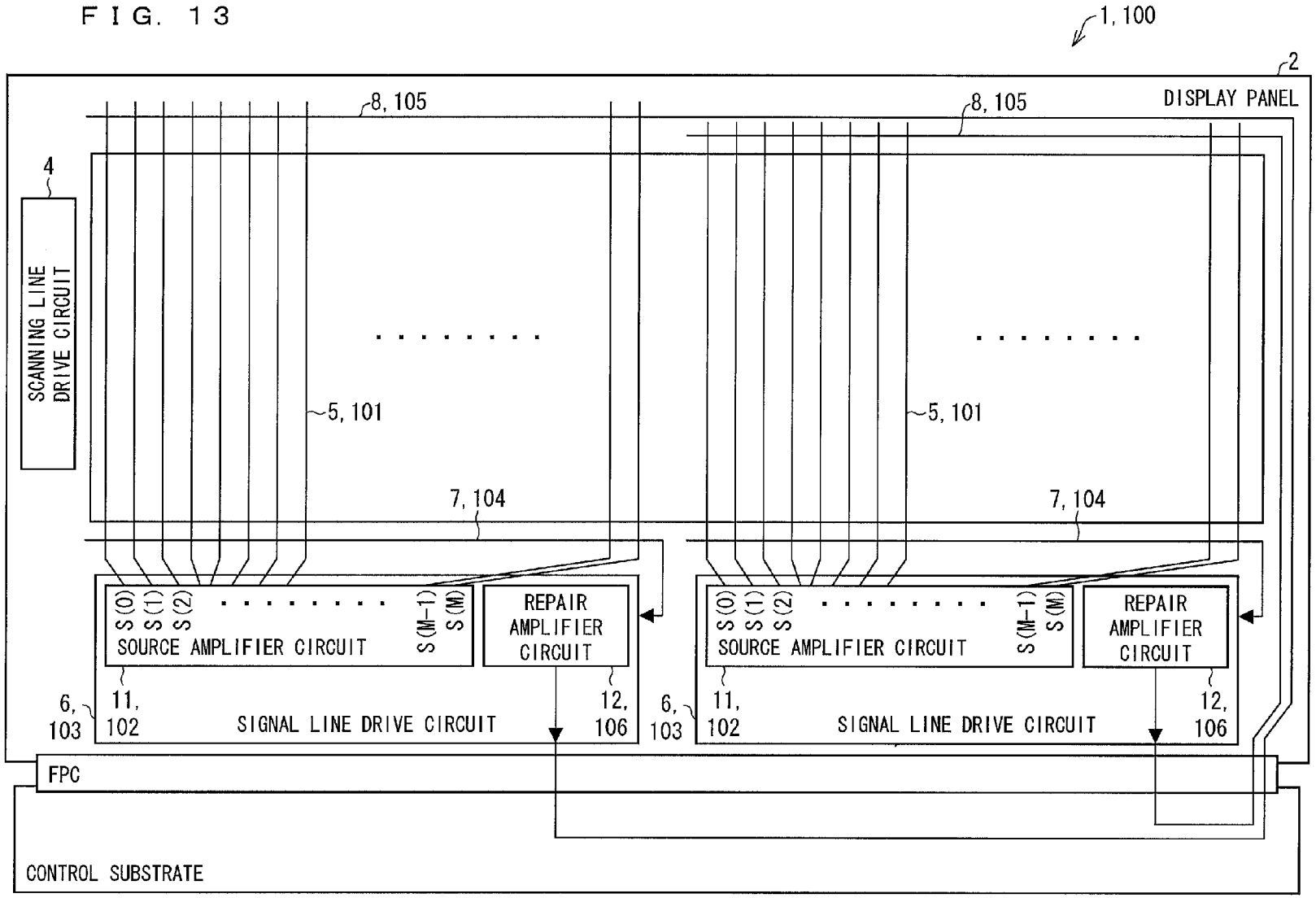
FIG. 13 illustrates an example of a technique of repairing a disconnection in a data signal line run from a signal line drive circuit with use of spare wires and a repair amplifier.
Figure 14:
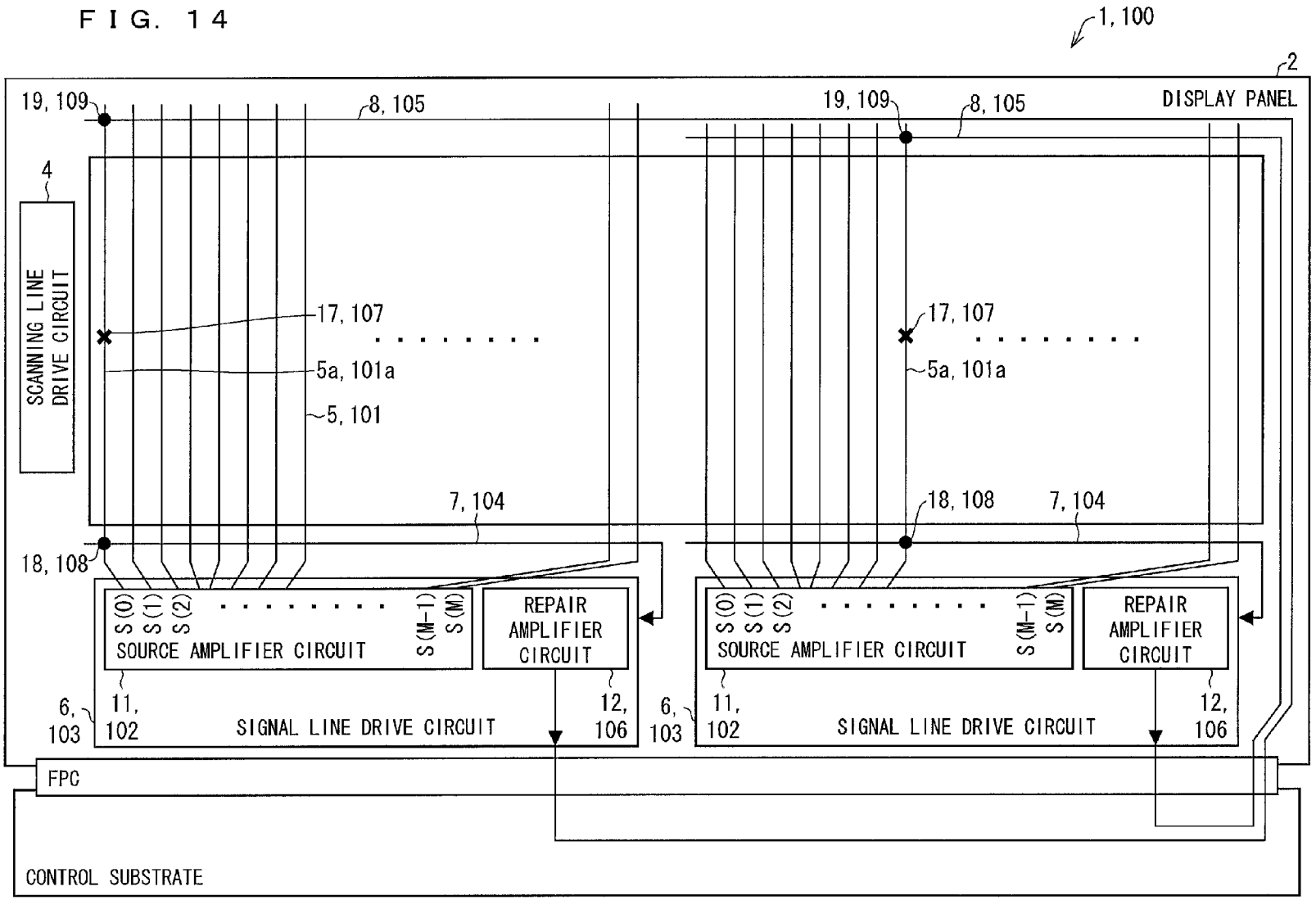
FIG. 14 shows how a display device shown in FIG. 13 repairs a disconnection in the data signal line.
Figure 15:
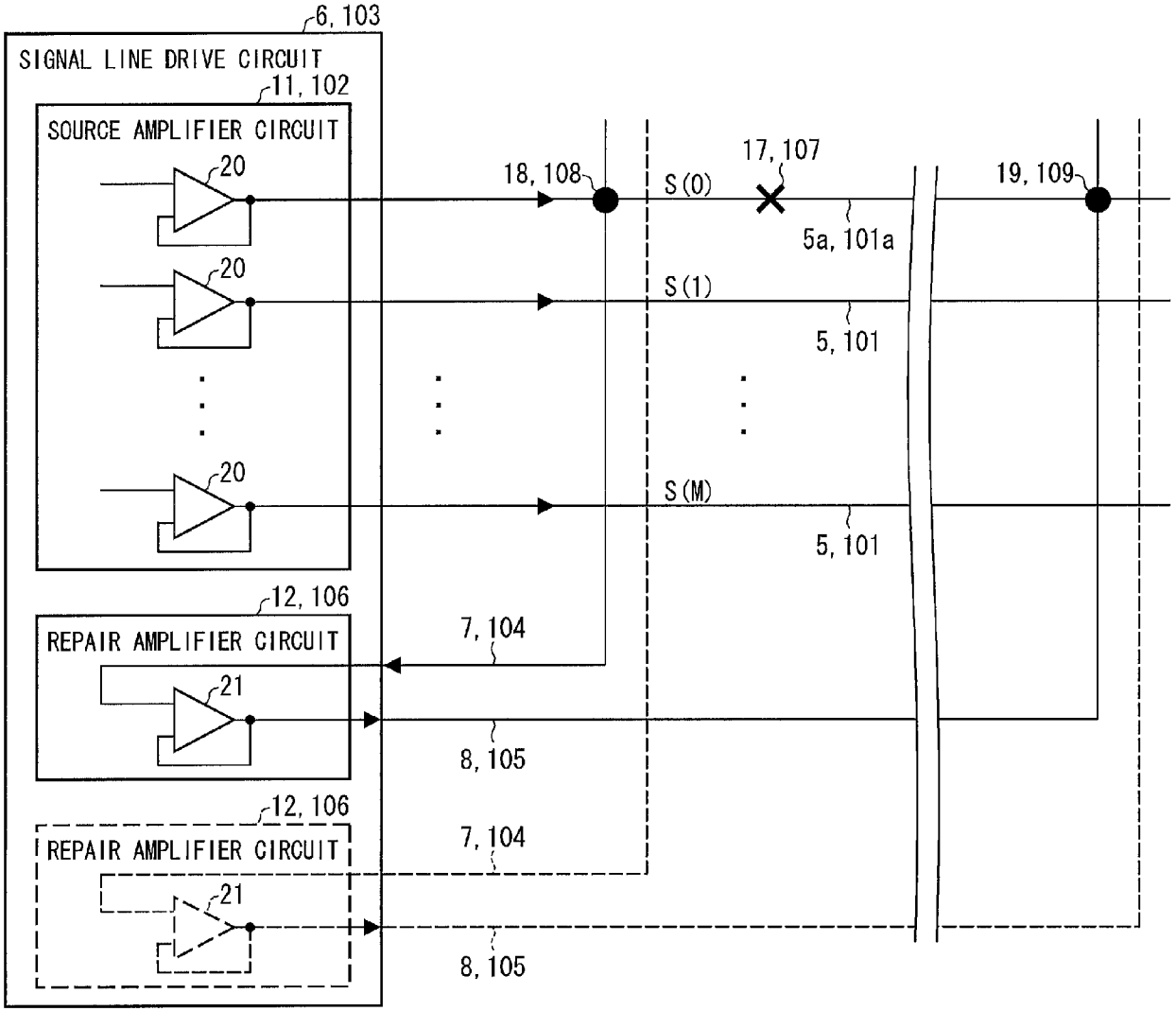
FIG. 15 illustrates a specific example of an arrangement of a display device including spare wires and repair amplifier circuits.

That is, how the display device 1 repairs a disconnection, which has been described so far, is the same as that of the display device 100 (see FIGS. 13 through 15).

The display device 1 corresponds to the display device 100. The data signal lines 5 corresponds to the data signal lines 101. The data signal line 5*a* corresponds to the data signal line 101*a*. The source amplifier circuit 11 corresponds to the source amplifier circuit 102. The signal line drive circuit 6 corresponds to the signal line drive circuit 103. The spare wire 7 and the spare wire 8 correspond to the spare wire 104 and the spare wire 105, respectively. The repair amplifier circuit 12 corresponds to the repair amplifier circuit 106. The disconnection 17 corresponds to the disconnection 107. The connection point 18 and the connection point 19 correspond to the connection point 108 and the connection point 109, respectively.

Figure 1:
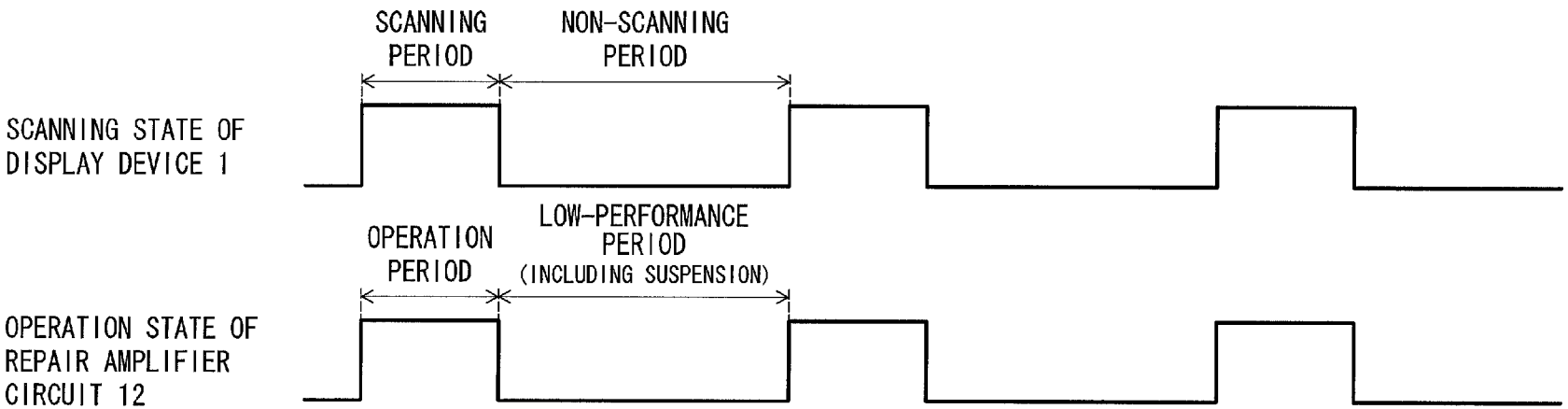
FIG. 1 is a timing chart showing a first example of when a repair amplifier control section reduces performance of a repair amplifier circuit.

FIG. 1 is a timing chart showing a first example of when the repair amplifier control section 14 reduces the performance of the repair amplifier circuit 12.

In the example shown in FIG. 1, the repair amplifier circuit 12 operates in the following manner under control of the repair amplifier control section 14.

That is, in a period during which scanning is carried out in the display device 1 (i.e., in a scanning period), the repair amplifier control section 14 generates a H level signal in response to the first drive suspension control signal supplied from the drive suspension control section 16, and supplies the H level signal to the repair amplifier circuit 12. This causes the repair amplifier circuit 12 to carry out, during the scanning period, the normal operation in which its performance is not reduced. In the following description, a period during which the repair amplifier circuit 12 carries out the normal operation is referred to as an operation period.

On the other hand, in a period during which no scanning is carried out in the display device 1 (i.e., in a non-scanning period), the repair amplifier control section 14 generates a L level signal in the same manner as in the scanning period, and supplies the L level signal to the repair amplifier circuit 12. This causes the repair amplifier circuit 12 to be in a low-performance state during the non-scanning period. In the following description, a period during which the repair amplifier circuit 12 is in a low-performance state which is lower than that in the case of the normal operation is referred to as a low-performance period.

Note that it is necessary that the repair amplifier circuit 12 carries out the normal operation at least during all the scanning periods. On the other hand, the repair amplifier circuit 12 may be in a low-performance state during any period within the non-scanning period.

Figure 2:
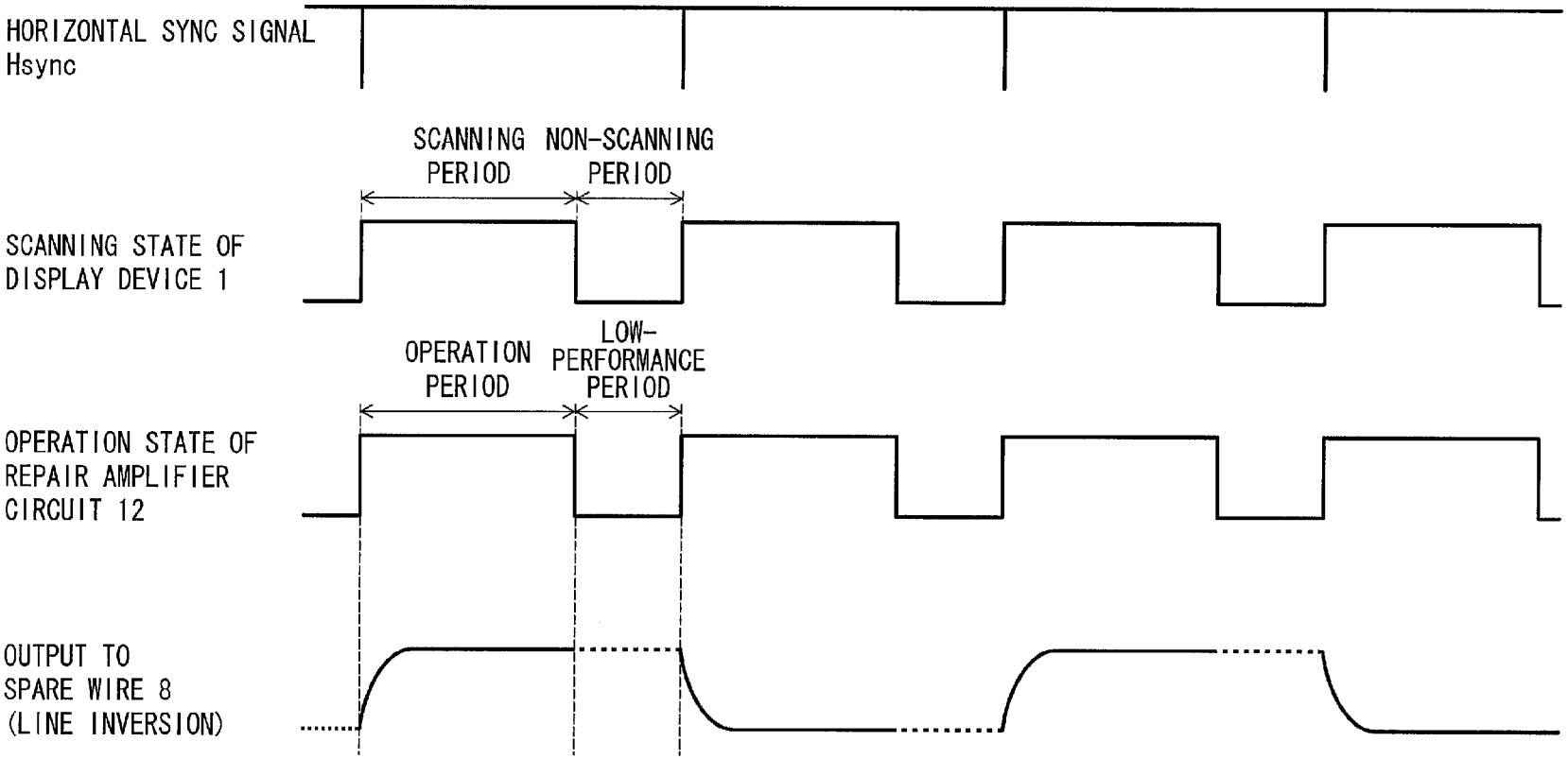
FIG. 2 is a timing chart showing a second example of when a repair amplifier control section reduces performance of a repair amplifier circuit.

FIG. 2 is a timing chart showing a second example of when the repair amplifier control section 14 reduces the performance of the repair amplifier circuit 12.

In the example shown in FIG. 2, the repair amplifier circuit 12 operates in the following manner under control of the repair amplifier control section 14.

That is, in one (1) horizontal period defined by one (1) cycle of the horizontal sync signal Hsync, a scanning period serves as the operation period of the repair amplifier circuit 12, as is the case with FIG. 1. During this scanning period, the repair amplifier control section 14 causes the repair amplifier circuit 12 to carry out the normal operation.

On the other hand, in the one (1) horizontal period, any period within a non-scanning period serves as the low-performance period, as is the case with FIG. 1. During this low-performance period, the repair amplifier control section 14 causes the repair amplifier circuit 12 to be in a low-performance state.

Figure 3:
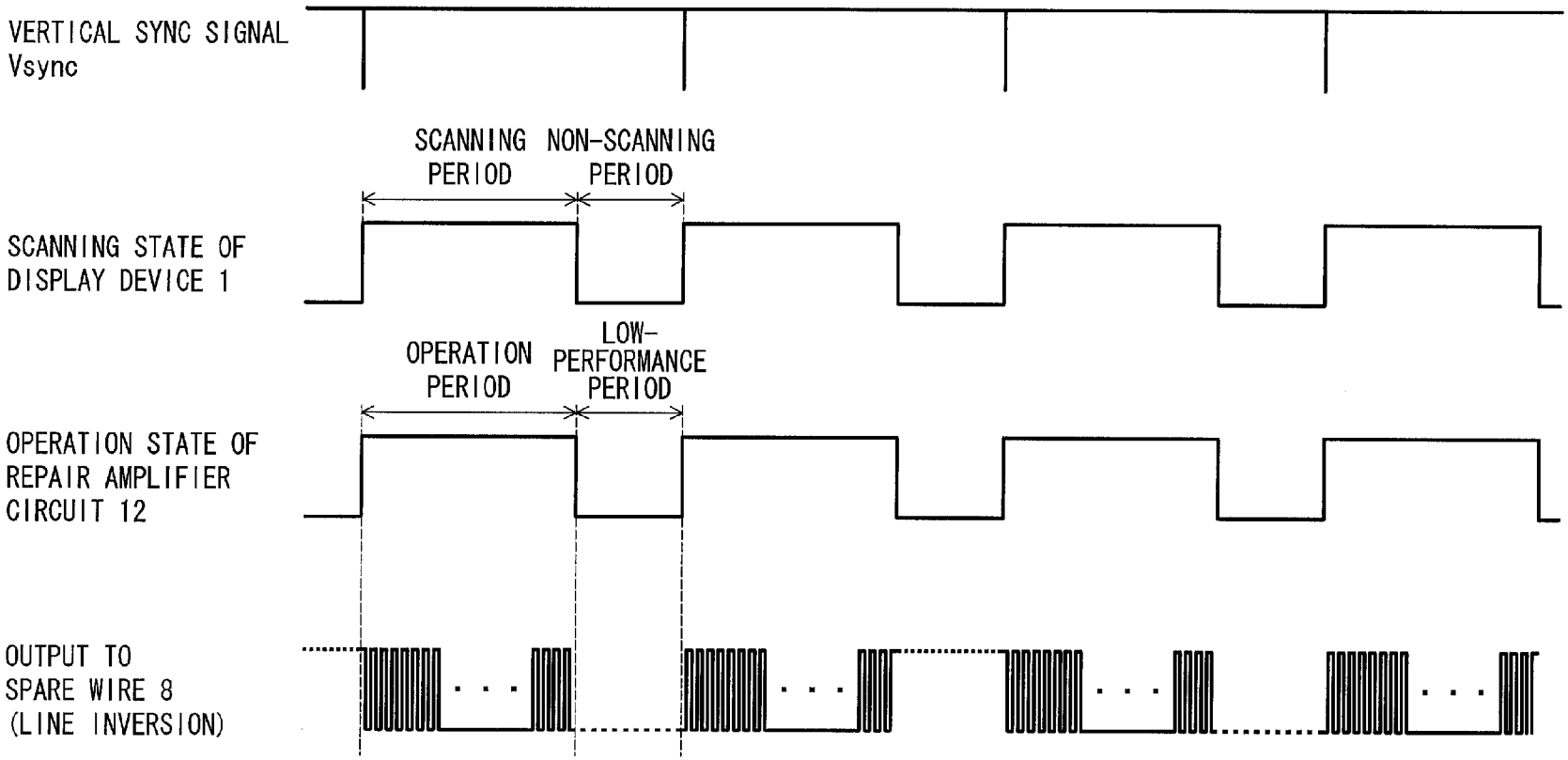
FIG. 3 is a timing chart showing a third example of when a repair amplifier control section reduces performance of a repair amplifier circuit.

FIG. 3 is a timing chart showing a third example of when the repair amplifier control section 14 reduces the performance of the repair amplifier circuit 12.

In the example shown in FIG. 3, the repair amplifier circuit 12 operates in the following manner under control of the repair amplifier control circuit 14.

That is, in one (1) vertical period defined by one (1) cycle of the vertical sync signal Vsync, a scanning period serves as the operation period of the repair amplifier circuit 12, as in the case with FIG. 1. During this scanning period, the repair amplifier control section 14 causes the repair amplifier circuit 12 to carry out the normal operation.

On the other hand, in the one (1) vertical period, any period within a non-scanning period serves as the low-performance period, as is the case with FIG. 1. During this low-performance period, the repair amplifier control section 14 causes the repair amplifier circuit 12 to operate at a low-performance level.

Figure 4:
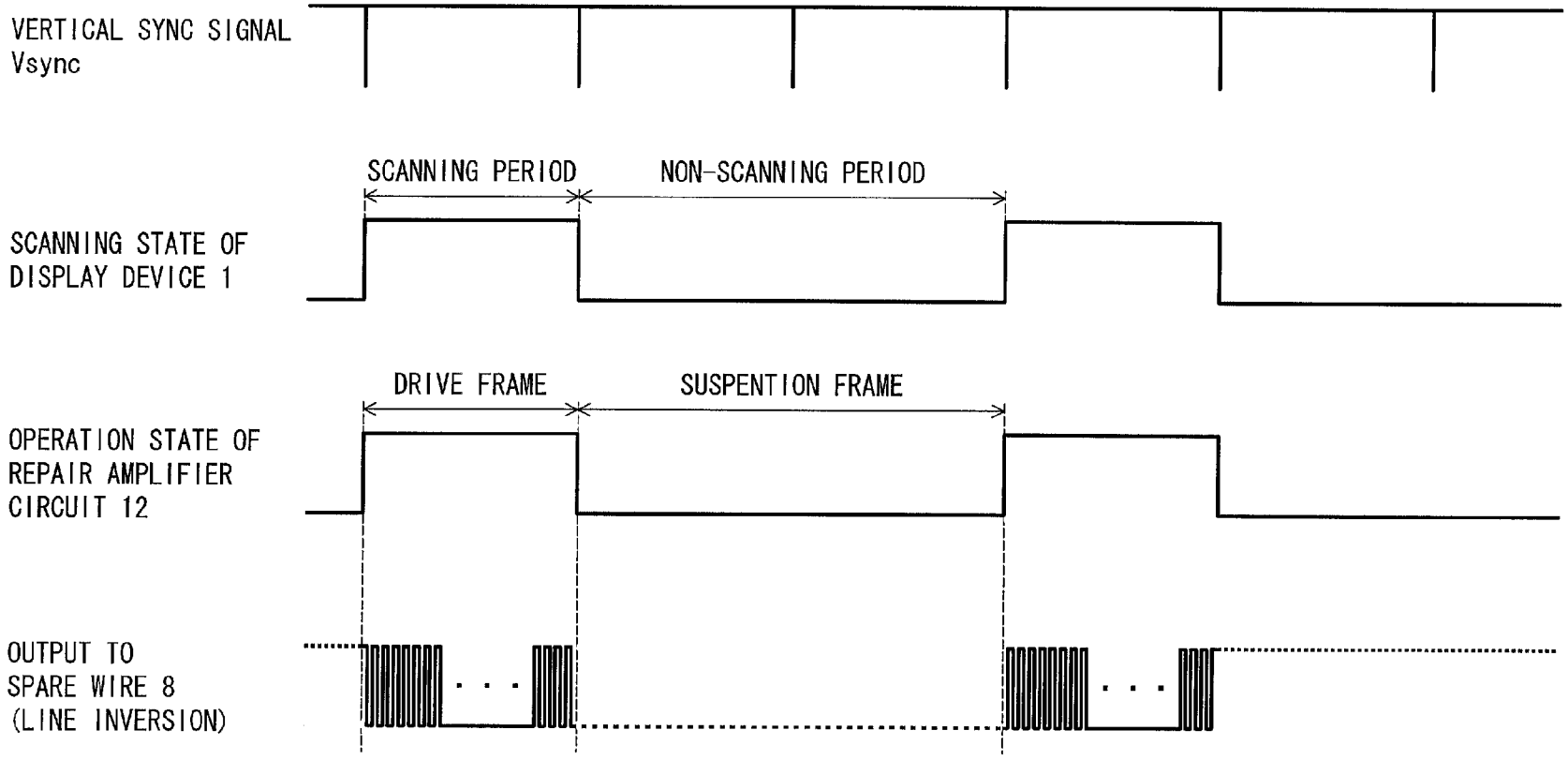
FIG. 4 is a timing chart showing a fourth example of when a repair amplifier control section reduces performance of a repair amplifier circuit.

FIG. 4 is a timing chart showing a fourth example of when the repair amplifier control section 14 reduces the performance of the repair amplifier circuit 12.

In the example shown in FIG. 4, the repair amplifier circuit 12 operates in the following manner under control of the repair amplifier control section 14.

That is, for example, assume that, when a display is carried out in the display device 1, there is a frame (suspension frame) during which no image is displayed. In this case, there may be a case where the repair amplifier circuit 12 does not need to be driven over one (1) vertical period that corresponds to the frame. If this is the case, the repair amplifier control section 14 may cause the repair amplifier circuit 12 to be in a low-performance state over the one (1) vertical period. In other words, the entire one (1) vertical period may serve as the low-performance period. That is, the repair amplifier control section 14 may cause the repair amplifier circuit 12 to be in a low-performance state over each one (1) vertical period.

Note that, in FIGS. 2 through 4, dotted lines show a state of a data signal supplied to the spare wire 8 during the low-performance period. During the periods indicated by the dotted lines, the state of the data signal may be at Hi-z (high impedance) or a ground level. Alternatively, the same level as in the operation period may be maintained.

The display device 1 is configured such that the repair amplifier circuit 12 to be in a low-performance state during any period within a period (non-scanning period) from when scanning is finished to when next scanning is started. This makes it possible to reduce electric power consumed by the repair amplifier circuit 12, during a period during which the repair amplifier circuit 12 is in the low-performance state.

Accordingly, it is possible to further reduce the electric power consumed by a display device capable of repairing a disconnection in a data signal line. Furthermore, by arranging the display device such that there is a period during which the operation of the repair amplifier circuit 12 is suspended, it is possible to achieve further reduction of electric power consumption.

Figure 6:
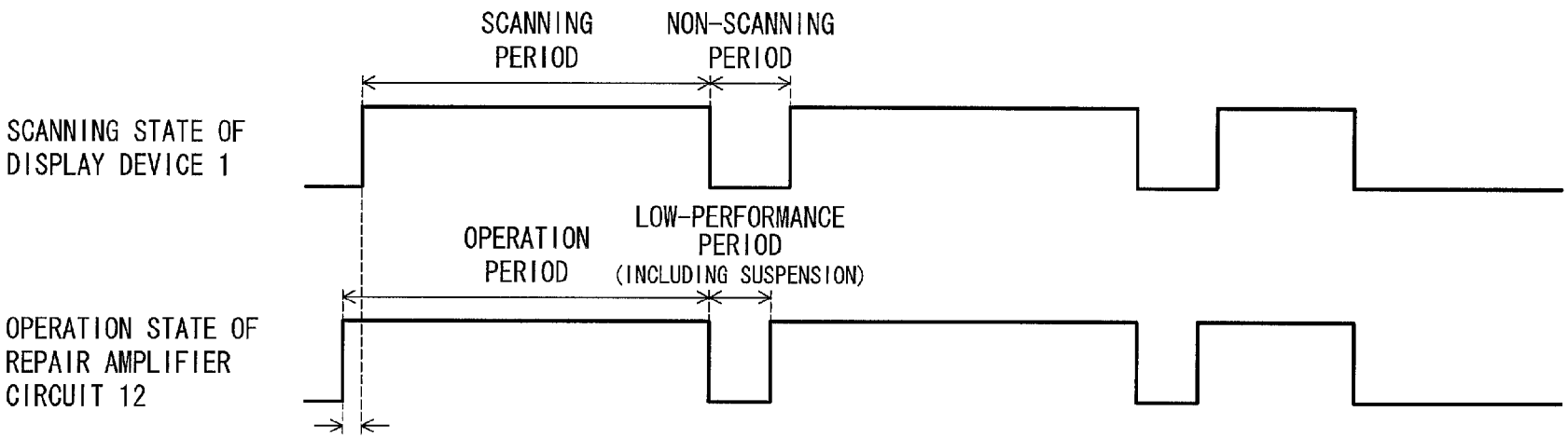
FIG. 6 is a timing chart showing a fifth example of when a repair amplifier control section reduces performance of a repair amplifier circuit.

FIG. 6 is a timing chart showing a fifth example of when the repair amplifier control section 14 reduces the performance of the repair amplifier circuit 12.

In the example shown in FIG. 6, the repair amplifier circuit 12 operates in the following manner under control of the repair amplifier control section 14.

That is, the repair amplifier circuit 12 undergoes a transition from its low-performance state to its normal operation state before a transition occurs from the non-scanning period into the scanning period. In other words, the low-performance state of the repair amplifier circuit 12 ends before the scanning period is started.

The end of the low-performance state of the repair amplifier circuit 12 means that the performance of the repair amplifier circuit 12, which is in a low-performance state, returns to the level for the normal operation.

In a case where the repair amplifier circuit 12 operates at a high performance level during the normal operation, it may take time from when the low-performance period ends to when the performance of the repair amplifier circuit 12 returns to the level for the normal operation.

The time from when the low-performance period ends to when the performance of the repair amplifier circuit 12 returns to the level for the normal operation is, for example, approximately several to several hundreds of microseconds, although the time depends on a specific configuration of the repair amplifier circuit 12. This is about twice as long as the time from when the low-performance state of the source amplifier circuit 11 starts ending to when the performance state of the source amplifier circuit 11 returns to the level for the normal operation.

In consideration of the time taken above, according to the example shown in FIG. 6, the low-performance state of the repair amplifier circuit 12 is finished before the scanning is started, preferably 100 μs or more prior to the timing of when the scanning period starts. This allows the repair amplifier circuit 12 to operate at a performance level for the normal operation from the start of the scanning.

Figure 7:
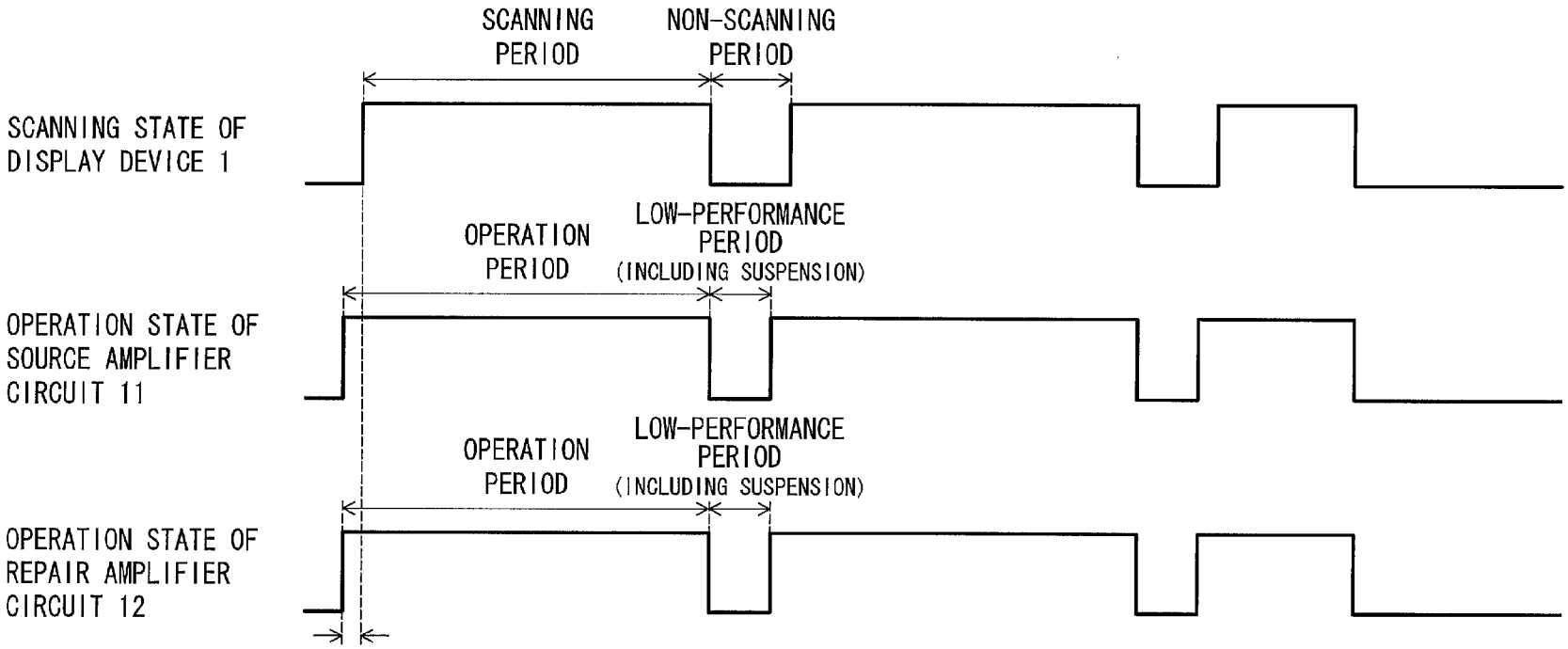
FIG. 7 is a timing chart showing a sixth example of when a repair amplifier control section reduces a performance of the repair amplifier circuit.

FIG. 7 is a timing chart showing a sixth example of when the repair amplifier control section 14 reduces the performance state of the repair amplifier circuit 12.

In the example shown in FIG. 7, the repair amplifier circuit 12 operates in the following manner under control by the repair amplifier control section 14. Furthermore, in the example shown in FIG. 7, the source amplifier circuit 11 operates in the following manner under control by the source amplifier control section 13.

That is, in a scanning period, the source amplifier control section 13 generates a H level signal in response to the second drive suspension control signal supplied from the drive suspension control section 16, and supplies the H level signal to the source amplifier circuit 11. With this, during the scanning period, the source amplifier circuit 11 carries out the normal operation in which its performance is not reduced. In the following description, a period during which the repair amplifier circuit 12 carries out the normal operation is referred to as an operation period of the repair amplifier circuit 12. Furthermore, in the following description, a period during which the source amplifier circuit 11 carries out the normal operation is referred to as an operation period of the source amplifier circuit 11.

On the other hand, in a non-scanning period, the source amplifier control section 13 generates a L level signal in the same manner as in the scanning period, and supplies the L level signal to the source amplifier circuit 11. With this, the source amplifier circuit 11 is in a low-performance state during the non-scanning period. In the following description, a period during which the repair amplifier circuit 12 is in a low-performance state lower than that in the case of the normal operation is referred to as the low-performance period of the repair amplifier circuit 12. Furthermore, in the following description, a period during which the source amplifier circuit 11 is in a low-performance state lower than that in the case of the normal operation is referred to as a low-performance period of the source amplifier circuit 11.

In addition, in the example shown in FIG. 7, the following is carried out. That is, in consideration of the time from when the low-performance period of the source amplifier circuit 11 ends to when the performance the source amplifier circuit 11 returns to the level for the normal operation, the low-performance state of the source amplifier circuit 11 is finished before the scanning is started, preferably, for example, 50 μs or more prior to the timing of when the scanning period starts. This allows the source amplifier circuit 11 to operate at a performance level for the normal operation from the start of the scanning.

The end of the low-performance state of the source amplifier circuit 11 means that the performance of the source amplifier circuit 11, which is in a low-performance state, returns to a performance level for the normal operation.

Furthermore, according to the example shown in FIG. 7, the low-performance state of the repair amplifier circuit 12 is finished concurrently with the end of the low-performance state of the source amplifier circuit 11. In other words, the timing of when the low-performance period of the repair amplifier circuit 12 ends is substantially the same as the timing of when the low-performance period of the source amplifier circuit 11 ends.

Since the low-performance state of the repair amplifier circuit 12 is finished before the scanning is started, it is possible to cause the repair amplifier circuit 12 to operate at a performance level for the normal operation from the start of the scanning.

Furthermore, since the arrangement of the source amplifier circuit 11 and the source amplifier control section 13 and the arrangement of the repair amplifier circuit 12 and the repair amplifier control section 14 are similar to each other, it is possible to achieve a display device 1 having a relatively simple configuration.

Figure 8:
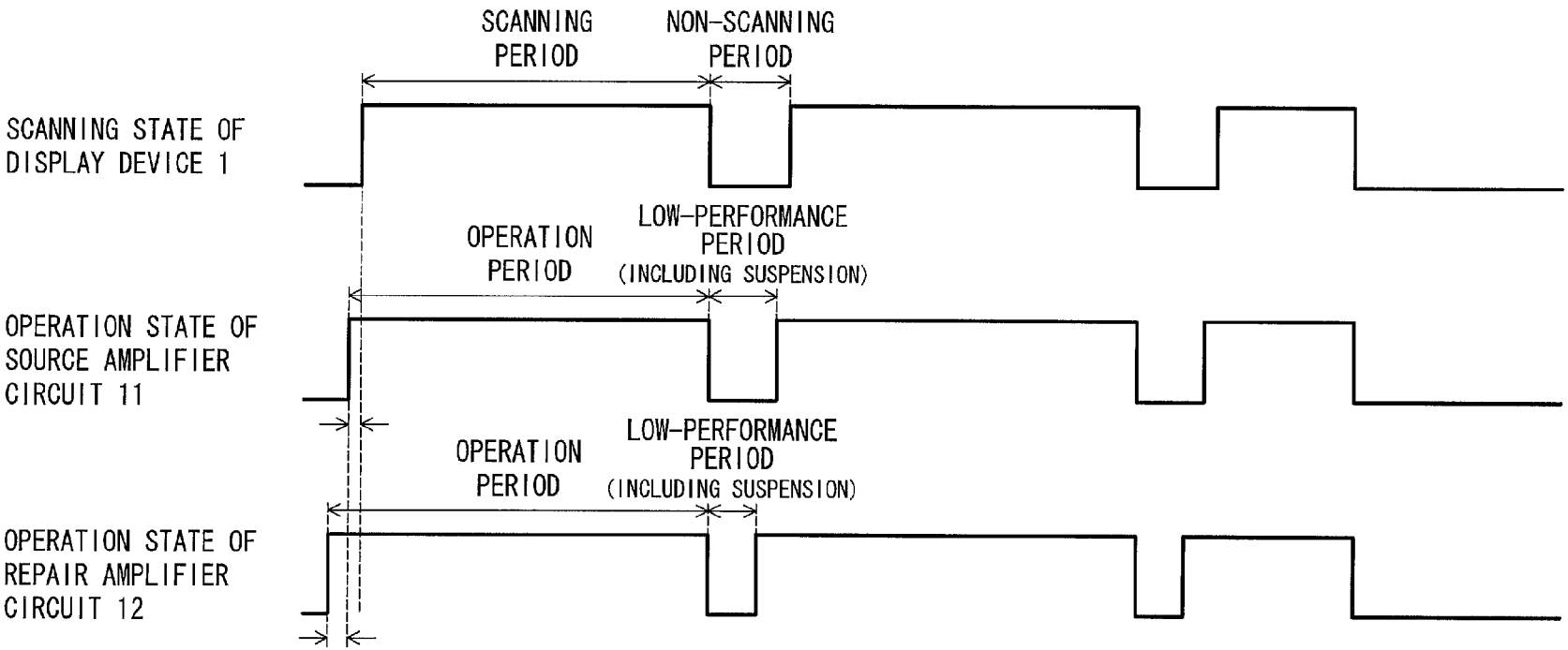
FIG. 8 is a timing chart showing a seventh example of when a repair amplifier control section reduces performance of a repair amplifier circuit.

FIG. 8 is s timing chart showing a seventh example of when the repair amplifier control section 14 reduces the performance of the repair amplifier circuit 12.

In the example shown in FIG. 8, the repair amplifier circuit 12 operates in the following manner under control by the repair amplifier control section 14. Furthermore, the source amplifier circuit 11 operates in a manner similar to that in the example shown in FIG. 7 under control by the source amplifier control section 13.

According to the example shown in FIG. 8, the low-performance state of the repair amplifier circuit 12 is finished before the low-performance state of the source amplifier circuit 11 is finished. That is, the timing of when the low-performance period of the repair amplifier circuit 12 ends before the timing of when the low-performance period of the source amplifier circuit 11 ends.

Since the low-performance state of the repair amplifier circuit 12 is finished before the scanning is started, it is possible to cause the repair amplifier circuit 12 to operate at a performance level for the normal operation from the start of the scanning.

Furthermore, it is possible to cause the low-performance period of the source amplifier circuit 11 to end after the low-performance period of the repair amplifier circuit 12 ends. As a result, even in a case where the time required for the performance of the repair amplifier circuit 12 to return to the level for the normal operation is longer than the time required for the performance of the source amplifier circuit 11 to return to the level for the normal operation, it is possible to ensure a sufficiently long low-performance period of the source amplifier circuit 11. Accordingly, it is possible to achieve further reduction of electric power consumption.

Figure 9:
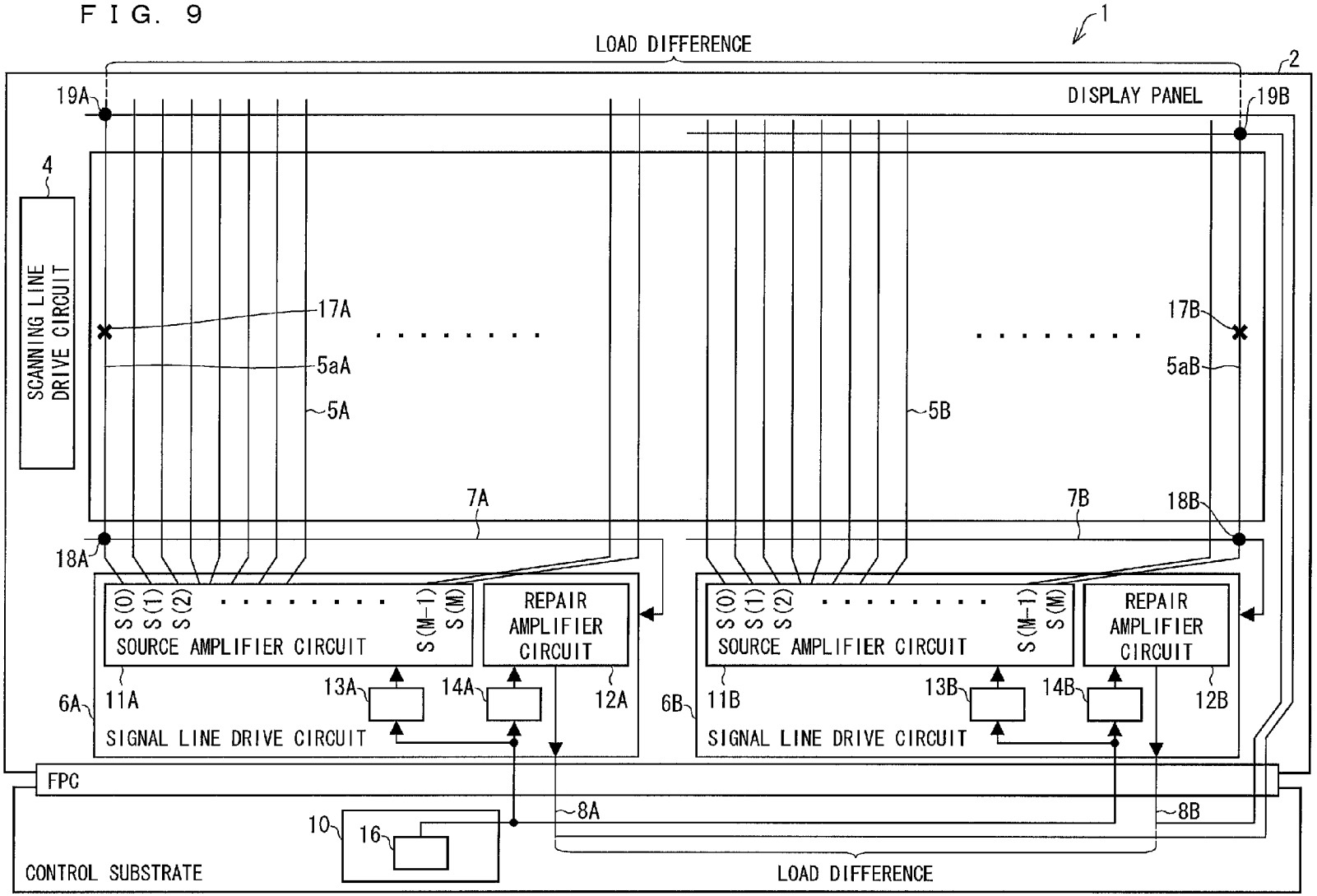
FIG. 9 is another view illustrating an arrangement of a display device in accordance with one embodiment of the present invention.

FIG. 9 is another view illustrating an arrangement of the display device 1. FIG. 9 corresponds to FIG. 14.

Figure 10:
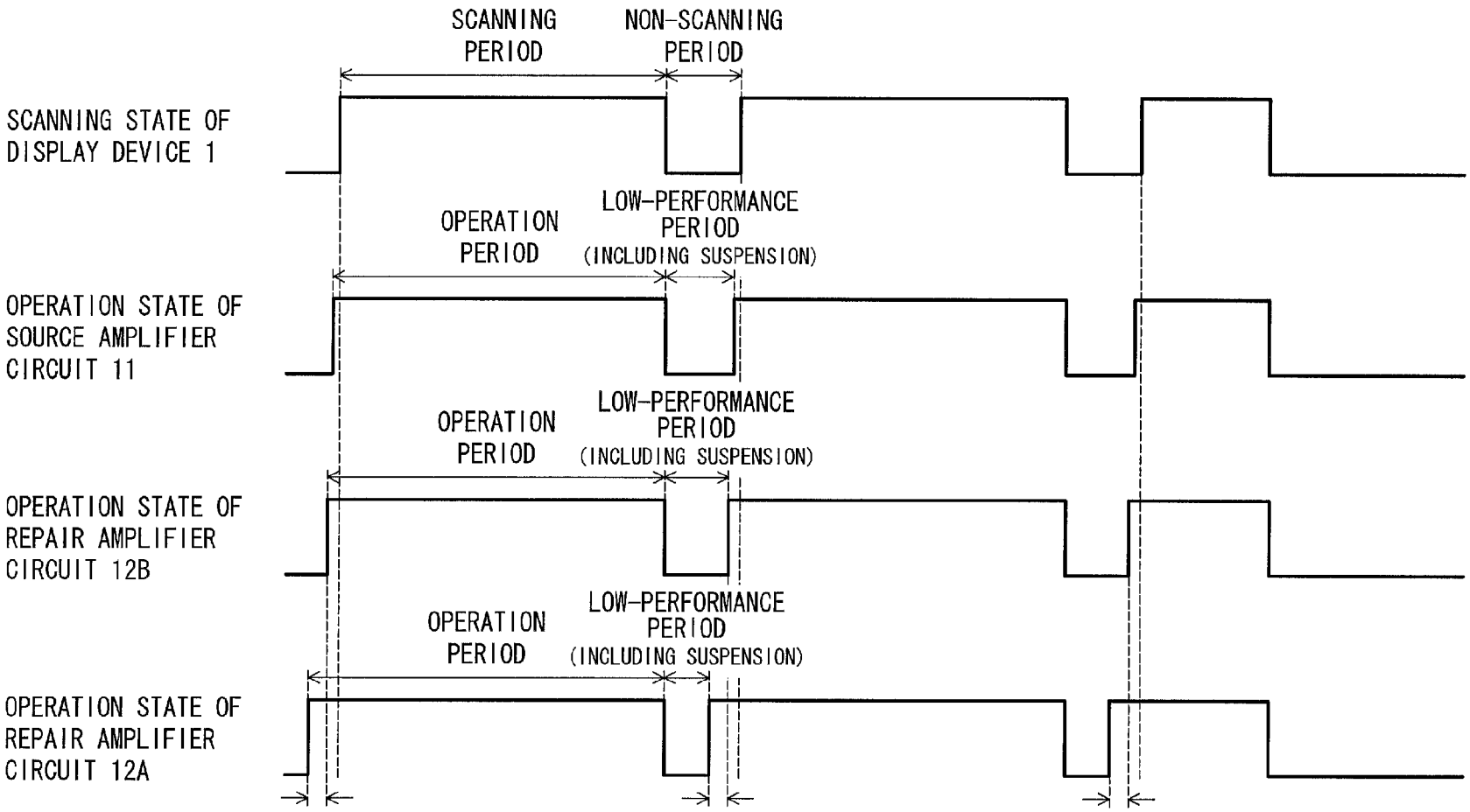
FIG. 10 is a timing chart showing an eighth example of when a repair amplifier control section reduces performance of a repair amplifier circuit.

FIG. 10 is a timing chart showing an eighth example of when the repair amplifier control circuit 14 reduces the performance of the repair amplifier circuit 12.

A set consisting of the spare wires 7 and 8 and the repair amplifier circuit 12, that is, a single disconnection repairing means, is capable of repairing a disconnection in one (1) data signal lines 5*a*. Therefore, there is provided two or more sets each consisting of the spare wires 7 and 8 and the repair amplifier circuit 12 in the display device 1 so that a plurality of data signal lines 5*a* having disconnections can be repaired.

In the following description, the above constituents corresponding to a signal line drive circuit 6 in the left part of FIG. 9 and other members associated with this signal line drive circuit 6 are each assigned "A" at the end of its reference number. On the other hand, the above constituents corresponding to a signal line drive circuit 6 in the right part of FIG. 9 and other members associated with this signal line drive circuit 6 are each assigned "B" at the end of its reference number.

A spare wire 8A is longer than a spare wire 8B. Because of this, a signal passing through the spare wire 8A is subjected to a larger load than a signal passing through the spare wire 8B. In consideration of this, it is necessary that a repair amplifier circuit 12A, which is connected to the spare wire 8A, operate at a higher performance level during the normal operation than a repair amplifier circuit 12B which is connected to the spare wire 8B. This means that the time from when the low-performance period ends to when the performance returns to the level for the normal operation is longer in the repair amplifier circuit 12A than in the repair amplifier circuit 12B.

In view of the circumstances, in the example shown in FIG. 10, the repair amplifier circuit 12 operates in the following manner under control by the repair amplifier control section 14.

According to the example shown in FIG. 10, the low-performance-state of the repair amplifier circuit 12A is finished before the low-performance state of the repair amplifier circuit 12B is finished. That is, the timing of when the low-performance period of the repair amplifier circuit 12A ends before the timing of when the low-performance period of the repair amplifier circuit 12B ends.

Furthermore, according to the example shown in FIG. 10, the low-performance state of each of the repair amplifier circuits 12A and 12B is finished before the low-performance period of the source amplifier circuit 11 is finished. That is, both the timing of when the low-performance period of the repair amplifier circuit 12A ends and the timing of when the low-performance period of the repair amplifier circuit 12B ends are before the timing of when the low-performance period of the source amplifier circuit 11 ends.

Since the low-performance state of the repair amplifier circuit 12 is finished before the scanning is started, it is possible to cause the repair amplifier circuit 12 to operate at a performance level for the normal operation from the start of the scanning.

Moreover, by arranging the display device 1 such that the low-performance state of a repair amplifier circuit 12 that is connected to a longer spare wire 8 is finished first, it is possible to ensure that the repair amplifier circuit 12 operates at a performance level for the normal operation from the start of scanning.

Figure 11:
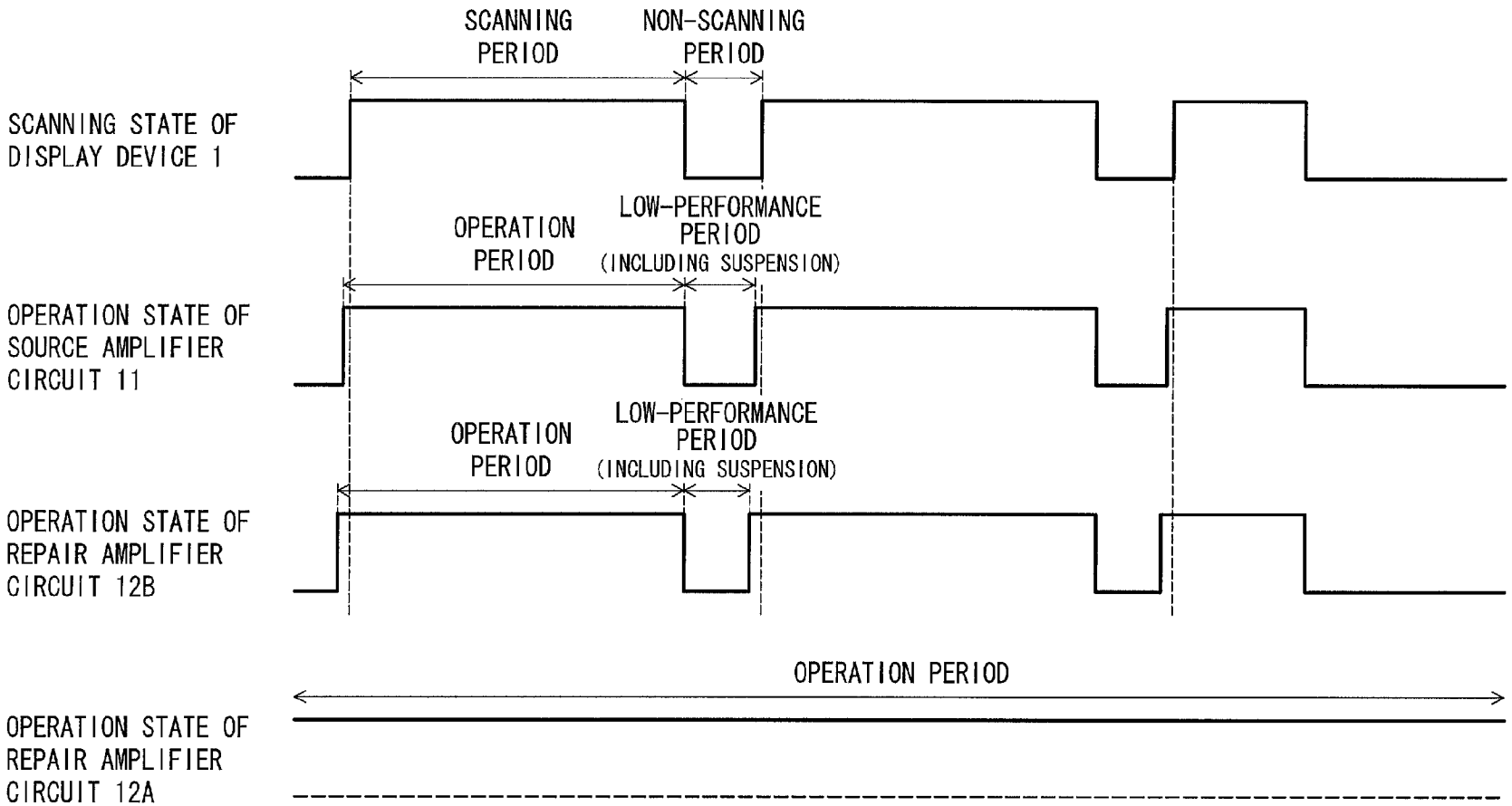
FIG. 11 is a timing chart showing a ninth example of when a repair amplifier control section reduces performance of a repair amplifier circuit.

FIG. 11 is a timing chart showing a ninth example of when the repair amplifier control section 14 reduces the performance of the repair amplifier circuit 12.

In the example shown in FIG. 11, the repair amplifier circuit 12 operates in the following manner under control by the repair amplifier control section 14. Furthermore, the source amplifier circuit 11 operates in a manner similar to that in the example shown in FIG. 10 under the source amplifier control section 13.

For example, there may be a case where the time from when the low-performance period of the repair amplifier circuit 12 ends to when the performance of the repair amplifier circuit 12 returns to the level for the normal operation is very long due to the very long length of the spare wire 8. In this case, there may be a case where it is difficult to provide a low-performance period of the repair amplifier circuit 12 within a non-scanning period.

In this case, the display device 1 can be configured such that the performance of the repair amplifier circuit 12 is not reduced.

FIG. 11 shows an example in which the time from when the low-performance period of the repair amplifier circuit 12A ends to when the performance of the repair amplifier circuit 12A returns to the level for the normal operation is longer than one (1) continuous non-scanning period due to the very long length of the spare wire 8A. In this case, it is difficult to provide the low-performance period of the repair amplifier circuit 12A within the one (1) continuous non-scanning period.

In view of the circumstances, the repair amplifier circuit 12A is configured to keep operating at a performance level for the normal operation, that is, no low-performance period is provided. On the other hand, for the repair amplifier circuit 12B, both the operation period and the low-performance period are provided.

Note that each of the examples shown in FIGS. 10 and 11 dealt with an example in which the reason why the repair amplifier 12 needs to operate at a high performance level during the normal operation is that the length of the spare wire 8 connected to the repair amplifier circuit 12 is long. However, the reason is not limited to the length of the spare wire 8 connected to the repair amplifier circuit 12.

That is, another reason is, for example, that the length of the data signal line 5*a* from the spare wire 8 to the disconnection 17 is long. Specifically, in a case where the length of a part of the data signal line 5*a* which part is from the spare wire 8 to the disconnection 17 is longer, a signal passing through such a part of the data signal line 5*a* is subjected to a larger load. In consideration of this, it is necessary to cause the repair amplifier circuit 12, which is connected to the spare wire 8 connected to the data signal line 5*a*, to operate at a higher performance level during the normal operation.

In the example shown in FIG. 10, in consideration of the performance level of the repair amplifier circuit 12A which performance level is determined in view of the above various factors, the low-performance period of the repair amplifier circuit 12A is finished before the end of the low-performance period of the repair amplifier circuit 12B.

Similarly, in the example shown in FIG. 11, in consideration of the performance level of the repair amplifier circuit 12A which performance level is determined in view of the above various factors, no low-performance period is provided for the repair amplifier circuit 12A.

In order to reduce electric power consumed by the display device 1, it is only necessary to cause at least one of all repair amplifier circuits 12 included in the display device 1 to be in a low-performance state during any period within a non-scanning period. By causing all the repair amplifier circuits 12 included in the display device 1 to be in a low-performance state during the non-scanning period, it is possible to further reduce power consumption. Moreover, by causing the repair amplifier circuit(s) 12 included in the display device 1 to be in a low-performance state during all non-scanning periods, it is possible to further reduce power consumption.

The display device 1 is configured to save electric power by causing a repair amplifier circuit(s) 12 to operate at a low-performance (low-driving performance) level during a non-scanning period(s). Note however that, by suspending the operation of the repair amplifier circuit(s) 12, it is possible to further reduce the electric power consumption. That is, according to the display device 1, it is possible to achieve the effects of the present invention also by "suspending the operation of a repair amplifier circuit(s) 12" in a non-scanning period(s) instead of "causing a repair amplifier circuit(s) 12 to operate at a low-performance level" in a non-scanning period (s). Note that a state in which the driving performance of the repair amplifier circuit 12 is the lowest corresponds to a state in which the operation of the repair amplifier circuit 12 is suspended.

Figure 12:
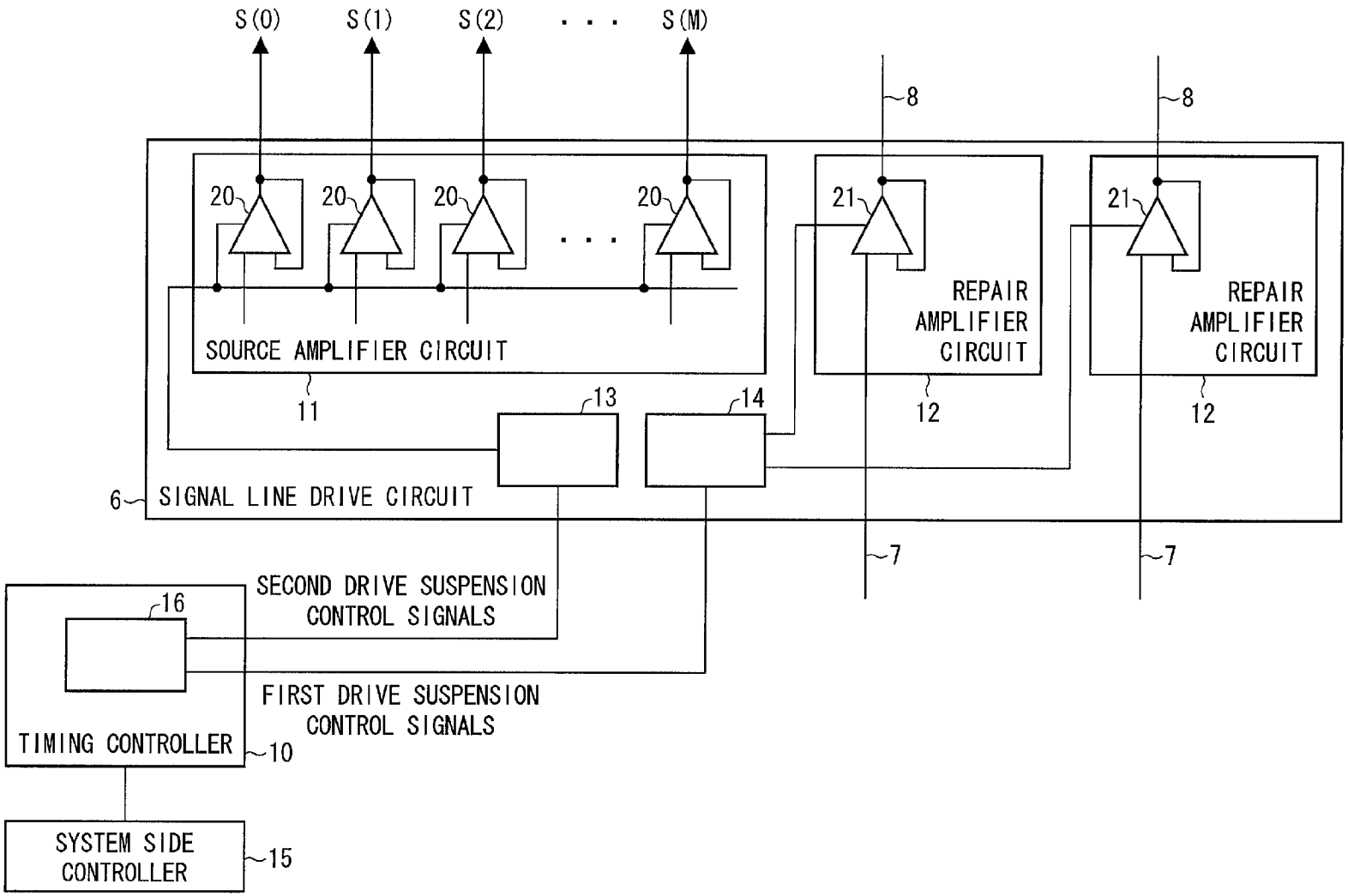
FIG. 12 schematically illustrates a specific example of an arrangement of a source amplifier circuit, repair amplifier circuits, a source amplifier control section, a repair amplifier control section, and a drive suspension control section.

FIG. 12 is a view schematically illustrating a specific example of an arrangement of the source amplifier circuit 11, the repair amplifier circuit 12, the source amplifier control section 13, the repair amplifier control section 14, and the drive suspension control section 16.

FIG. 12 illustrates an example in which one (1) signal line drive circuit 6 includes one (1) source amplifier circuit 11 and two repair amplifier circuits 12.

The source amplifier circuit 11 includes a plurality of analog amplifiers 20 (in this example, M+1 analog amplifiers). The plurality of analog amplifiers 20 have output terminals connected to respective different data signal lines 5 and are connected to the source amplifier control section 13.

Each of the repair amplifier circuits 12 includes one (1) amplifier 21. These amplifiers 21 have input terminals connected to respective different spare wires 7 and output terminals connected to respective different spare wires 8, and are connected to the repair amplifier control section 14.

For example, in a case where the example shown in FIG. 1 is carried out, the drive suspension control section 16 generates, in response to a signal supplied from the system-side control section 15, repair amplifier performance control information corresponding to the timing chart indicated as "OPERATION STATE OF REPAIR AMPLIFIER CIRCUIT 12" in FIG. 1. The same process is carried out also in the case where any of the examples shown in FIGS. 2 through 4 and FIGS. 6 through 8 is carried out.

Note, here, that the "repair amplifier performance control information" is information indicative of whether or not to reduce the performance of the repair amplifier circuit 12 or information indicative of a period during which the performance of the repair amplifier circuit 12 is to be reduced.

Furthermore, for example, in a case where the example shown in FIG. 10 is carried out, the drive suspension control section 16 generates, in response to a signal supplied from the system-side control section 15, (i) repair amplifier performance control information corresponding to the timing chart indicated as "OPERATION STATE OF REPAIR AMPLIFIER CIRCUIT 12A" in FIG. 10 and (ii) repair amplifier performance control information corresponding to the timing chart indicated as "OPERATION STATE OF THE REPAIR AMPLIFIER CIRCUIT 12B" in FIG. 10. The same process is carried out also in the case where the example shown in FIG. 11 is carried out.

Note that the repair amplifier performance control information can be stored in EEPROM (not illustrated) or the like in the display device 1 in advance.

The drive suspension control section 16 generates, in accordance with the repair amplifier performance control information, a first drive suspension control signal which is in synchronization with the video sync signals (the horizontal sync signal Hsync and/or the vertical sync signal Vsync), and supplies the first drive suspension control signal to the repair amplifier control section 14.

In a case where the first drive suspension control signal thus supplied indicates the normal operation of the repair amplifier circuits 12, the repair amplifier control section 14 supplies, for example, a H level signal to each of the amplifiers 21 constituting the repair amplifier circuits 12. On the other hand, in a case where the first drive suspension control signal thus supplied indicates the low-performance state of the repair amplifier circuits 12, the repair amplifier control section 14 supplies, for example, a L level signal to each of the amplifiers 21 constituting the repair amplifier circuits 12.

In a case where the signal supplied from the repair amplifier control section 14 is at H level, each of the amplifiers 21 carries out the normal operation. On the other hand, in a case where the signal supplied from the repair amplifier control section 14 is at L level, each of the amplifiers 21 is in a lower performance state lower than that in the case of the normal operation. With this arrangement, each of the repair amplifier circuits 12 carries out the normal operation in the case where the signal supplied from the repair amplifier control section 14 is at H level and operates at a lower performance level lower than that in the case of the normal operation in the case where the signal supplied from the repair amplifier control section 14 is at L level.

Furthermore, for example in a case where the example shown in FIG. 7 is carried out, the drive suspension control section 16 generates, in response to a signal supplied from the system-side control section 15, source amplifier performance control information corresponding to the timing chart indicated as "OPERATION STATE OF SOURCE AMPLIFIER CIRCUIT 11" in FIG. 7. The same process is carried out also in the case where any of the examples shown in FIGS. 8, 10, and 11 is carried out.

Note, here, that the "source amplifier performance control information" is information indicative of whether or not to reduce the performance of the source amplifier circuit 11, or information indicative of a period during which the performance of the source amplifier circuit 11 is to be reduced.

The drive suspension control section 16 generates, in accordance with the source amplifier performance control information, a second drive suspension control signal which is in synchronization with the video sync signals, and supplies the second drive suspension control signal to the source amplifier control section 13.

In a case where the second drive suspension control signal thus supplied indicates the normal operation of the source amplifier circuit 11, the source amplifier control section 13 supplies, for example, a H level signal to each of the analog amplifiers 20 constituting the source amplifier circuit 11. On the other hand, in a case where the second drive suspension control signal thus supplied indicates the low-performance operation of the source amplifier circuit 11, the source amplifier control section 13 supplies, for example, a L level signal to each of the analog amplifiers 20 constituting the source amplifier circuit 11.

In a case where the signal supplied from the source amplifier control section 13 is at H level, each of the analog amplifiers 20 carries out the normal operation. On the other hand, in a case where the signal supplied from the source amplifier control section 13 is at L level, each of the analog amplifiers 20 operates at a lower performance level lower than that in the case of the normal operation. With this arrangement, the source amplifier circuit 11 carries out the normal operation in the case where the signal supplied from the source amplifier control section 13 is at H level and operates at a lower performance level lower than that in the case of the normal operation in the case where the signal supplied from the source amplifier control section 13 is at L level.

It is needless to say that the signal line drive circuit 6 may include one or three or more repair amplifier circuits, and the display device 1 may include two or more sets of the constituents shown in FIG. 12.

The display device 1 including a plurality of signal line drive circuits 6 is likely a large display device. In many cases, such a display device 1 includes a plurality of repair amplifier circuits 12 in order to prevent a reduction in yield which is attributed to disconnections in the data signal lines 5. Therefore, each of the configurations described so far is advantageous to the display device 1.

The display device 1 may be a liquid crystal display device or some other display device such as an organic EL (Electro Luminescence) display device.

The aforesaid arrangements of the display device 1 can be construed as a method for driving the display device 1 as below.

A method for driving a display device 1 which includes: a data signal line for supplying, to a display area, a signal necessary for display; a first wire connectable to the data signal line, the first wire being provided on a first side of the display area on which first side the data signal line receives the signal; a second wire connectable to the data signal line, the second wire being provided on a second side of the display area which second side is opposite to the first side; an amplifier circuit which has an input terminal connected to the first wire and an output terminal connected to the second wire, said method comprising the step of: causing the amplifier circuit to operate at a low-performance level during any period within a period from when scanning of pixels in the display area is finished to when next scanning is started.

Furthermore, the display device of the present invention is preferably arranged such that the performance controlling means causes the amplifier circuit to operate at a low-performance level by suspending operation of the amplifier circuit.

According to the arrangement, since the operation of the amplifier circuit is suspended, electric power consumption is further reduced.

The display device of the present invention is preferably arranged such that the performance controlling means causes the amplifier circuit to operate at a low-performance level during any period within one horizontal period.

According to the arrangement, it is possible to cause the amplifier circuit to be in a low-performance state during a period, which is within one horizontal period, from when the signal finishes being inputted to the data signal line to when the one horizontal period ends.

Furthermore, the display device of the present invention is preferably arranged such that the performance controlling means causes the amplifier circuit to operate at a low-performance level during any period within one vertical period.

According to the arrangement, it is possible to cause the amplifier circuit to be in a low-performance state during a period, which is within one vertical period, from when signals finish being inputted to the data signal line to when the one vertical period ends.

The display device of the present invention is preferably arranged such that the performance controlling means causes the amplifier circuit to operate at a low-performance level over one of a plurality of vertical periods.

According to the arrangement, it is possible to cause the amplifier circuit to be in a low-performance state over one vertical period, that is, over each one (1) frame period during which an image is to be displayed. This arrangement is advantageous in a case where one vertical period, during which the amplifier circuit is in the low-performance state, corresponds to a frame (suspension frame) in which no images are displayed.

Furthermore, the display device of the present invention is preferably arranged such that the performance controlling means causes the low-performance state of the amplifier circuit to end before the scanning is started.

In a case where the amplifier circuit operates at a high performance level during the normal operation, it may take time from when the low-performance period starts ending to when the performance of the amplifier circuit returns to the level for the normal operation.

According to the arrangement, since the low-performance state of the amplifier circuit ends before the scanning is started, it is possible to cause the amplifier circuit to operate at a performance level for the normal operation from the start of the scanning.

The display device of the present invention preferably includes: a data signal generating circuit for generating the signal and supplying the signal (i) to the data signal line and (ii) to the amplifier circuit via the first wire which is connected to the data signal line; and data signal generation ability controlling means for causing the data signal generating circuit to operate at a low-performance level during any period within the period from when the scanning is finished to when the next scanning is started.

According to the arrangement, since the performance of the data signal generating circuit is reduced, it is possible to further reduce electric power consumption.

The display device of the present invention is preferably arranged such that the data signal generation ability controlling means causes the low-performance state of the data signal generating circuit to end before the scanning is started; and the performance controlling means causes the low-performance state of the amplifier circuit to end at a time when the data signal generation ability controlling means causes the low-performance state of the data signal generating circuit to end.

According to the arrangement, since the low-performance state of the amplifier circuit ends before the scanning is started, it is possible to cause the amplifier circuit to operate at a performance level for the normal operation from the start of the scanning.

Furthermore, according to the arrangement, since the arrangement of the amplifier circuit and the performance controlling means and the arrangement of the data signal generating circuit and the data signal generation ability controlling means are similar to each other, it is possible to achieve a display device 1 having a relatively simple configuration.

The display device of the present invention is preferably arranged such that the data signal generation ability controlling means causes the low-performance state of the data signal generating circuit to end before the scanning is started; and the performance controlling means causes the low-performance state of the amplifier circuit to end before the data signal generation ability controlling means causes the low-performance state of the data signal generating circuit to end.

According to the arrangement, since the low-performance state of the amplifier circuit ends before the scanning is started, it is possible to cause the amplifier circuit to operate at performance level for the normal operation from the start of the scanning.

Furthermore, according to the arrangement, it is possible to cause the low-performance period of the data signal generating circuit to end after the low-performance period of the amplifier circuit ends. With this arrangement, even in a case where the time required for the performance of the amplifier circuit to return to the level for the normal operation is longer than the time required for the performance of the data signal generation circuit to return to the level for the normal operation, it is possible to cause the data signal generating circuit to operate at a low-performance level for a long time. As a result, it is possible to achieve further reduction of electric power consumption.

The display device of the present invention includes: a plurality of disconnection repairing means each of which (i) includes the first wire, the second wire and the amplifier circuit and (ii) is configured to repair a disconnection in the data signal line by connecting the first wire and the second wire to the data signal line, the plurality of disconnection repairing means being configured such that the low-performance state of the amplifier circuit connected to the second wire which is longer in length is finished first.

A longer second wire imposes a larger load on a signal that is outputted from an amplifier circuit corresponding to the second wire and passes through the second wire. Therefore, this amplifier circuit needs to operate at a higher performance level. That is, in some cases, the longer the second wire becomes, the longer the time from when the low-performance state of the amplifier circuit starts ending to when the performance of the amplifier circuit returns to the level for the normal operation.

According to the arrangement, the low-performance state of an amplifier circuit that is connected to a longer second wire is finished first. This makes it possible to cause the amplifier circuit to operate at a performance level for the normal operation from the start of the scanning.

The display device of the present invention includes: a/the plurality of disconnection repairing means each of which (i) includes the first wire, the second wire and the amplifier circuit and (ii) is configured to repair a disconnection in the data signal line by connecting the first wire and the second wire to the data signal line; and the performance controlling means being configured not to reduce performance of the amplifier circuit in at least one of the plurality of disconnection repairing means.

For example, there may be a case where the time from when the low-performance period of the amplifier circuit ends to when the performance of the amplifier circuit returns to the level for the normal operation is longer, due to the very long length of the spare wire, than a period in which it is possible to reduce performance of the amplifier circuit. In this case, the display device can be arranged such that the performance of the amplifier circuit is not reduced.

The display device of the present invention may be arranged to include a plurality of signal line drive circuits each of which is configured to drive the data signal line by supplying the signal to the data signal line.

Many large-size display devices include a plurality of signal line drive circuits and a plurality of amplifier circuits. Therefore, such large-size display devices more benefit from the effects of electric power saving which are brought about by the present invention.

The display device of the present invention is preferably arranged such that the display device is a liquid crystal display device.

The present invention is not limited to the description of the embodiments above, but can be may be altered by a skilled person within the scope of the claims. An embodiment based on a proper combination of technical means disclosed in different embodiments is encompassed in the technical scope of the present invention.

INDUSTRIAL APPLICABILITY

A display device in accordance with the present invention can be extensively used as various display devices such as a liquid crystal display device, an organic EL display device, and the like.

REFERENCE SIGNS LIST

1 Display device
5 Data signal line
7 Spare wire (first wire)
8 Spare wire (second wire)
8A Spare wire (second wire)
8B Spare wire (second wire)
10 Timing controller
11 Source amplifier circuit (data signal generating circuit)
12 Repair amplifier circuit (amplifier circuit)
12A Repair amplifier circuit (amplifier circuit)
12B Repair amplifier circuit (amplifier circuit)
13 Source amplifier control section (data signal generation ability controlling means)
14 Repair amplifier control section (performance controlling means)
15 System-side control section

The invention claimed is:

1. A display device comprising:

a data signal line configured to supply, to a display area, a signal necessary for display;

a first wire connectable to the data signal line, the first wire being provided on a first side of the display area, the data signal line receives the signal on the first side of the display area;

a second wire connectable to the data signal line, the second wire being provided on a second side of the display area which is opposite to the first side;

an amplifier circuit which includes an input terminal connected to the first wire and an output terminal connected to the second wire;

a performance controller configured or programmed to cause the amplifier circuit to be in a low-performance state during any period within a period from when scanning of pixels in the display area is finished to when next scanning is started;

a data signal generating circuit configured to generate the signal and to supply the signal (i) to the data signal line and (ii) to the amplifier circuit via the first wire which is connectable to the data signal line; and a data signal generation ability controller configured or programmed to cause the data signal generating circuit to be in a low-performance state during any period within the period from when the scanning is finished to when the next scanning is started; wherein the data signal generation ability controller is configured or programmed to cause the low-performance state of the data signal generating circuit to end before the scanning is started; and the performance controller is configured or programmed to cause the low-performance state of the amplifier circuit to end before the data signal generation ability controller causes the low-performance state of the data signal generating circuit to end.

2. The display device as set forth in claim 1, wherein the performance controller is configured or programmed to cause the amplifier circuit to be in the low-performance state by suspending operation of the amplifier circuit.

3. The display device as set forth in claim 1, wherein the performance controller is configured or programmed to cause the amplifier circuit to be in the low-performance state during any period within one horizontal period.

4. The display device as set forth in claim 1, wherein the performance controller is configured or programmed to cause the amplifier circuit to be in the low-performance state during any period within one vertical period.

5. The display device as set forth in claim 1, wherein the performance controller is configured or programmed to cause the amplifier circuit to be in the low-performance state over one of a plurality of vertical periods.

6. The display device as set forth in claim 1, wherein the performance controller is configured or programmed to cause the low-performance state of the amplifier circuit to end before the scanning is started.

7. The display device as set forth in claim 1, wherein:

the data signal generation ability controller is configured or programmed to cause the low-performance state of the data signal generating circuit to end before the scanning is started; and the performance controller is configured or programmed to cause the low-performance state of the amplifier circuit to end at a time when the data signal generation ability controller is configured or programmed to cause the low-performance state of the data signal generating circuit to end.

8. A display device as set forth in claim 1, comprising:

a plurality of disconnection repairing circuits each of which (i) includes the first wire, the second wire, and the amplifier circuit and (ii) is configured to repair a disconnection in the data signal line by connecting the first wire and the second wire to the data signal line, the plurality of disconnection repairing circuits being configured such that the low-performance state of the amplifier circuit connected to the second wire is finished first, a length of the second wire is greater than a length of the first wire.

9. A display device as set forth in claim 1, comprising:

a plurality of disconnection repairing circuits each of which (i) includes the first wire, the second wire, and the amplifier circuit and (ii) is configured to repair a disconnection in the data signal line by connecting the first wire and the second wire to the data signal line; and the performance controller is configured or programmed not to reduce performance of the amplifier circuit in at least one of the plurality of disconnection repairing circuits.

10. A display device as set forth in claim 1, comprising a plurality of signal line drive circuits each of which is configured to drive the data signal line by supplying the signal to the data signal line.

11. The display device as set forth in claim 1, wherein the display device is a liquid crystal display device.

12. A method for driving a display device, the display device including:

a data signal line configured to supply, to a display area, a signal necessary for display;

a first wire connectable to the data signal line, the first wire being provided on a first side of the display area, the data signal line receives the signal on the first side of the display device;

a second wire connectable to the data signal line, the second wire being provided on a second side of the display area which is opposite to the first side;

an amplifier circuit which includes an input terminal connected to the first wire and an output terminal connected to the second wire, said method comprising the steps of:

causing the amplifier circuit to be in a low-performance state during any period within a period from when scanning of pixels in the display area is finished to when next scanning is started;

supplying the signal (i) to the data signal line and (ii) to the amplifier circuit via the first wire which is connectable to the data signal line;

causing a data signal generating circuit to be in a low-performance state during any period within the period from when the scanning is finished to when the next scanning is started;

causing the low-performance state of the data signal generating circuit to end before the scanning is started; and causing the low-performance state of the amplifier circuit to end before a data signal generation ability controller causes the low-performance state of the data signal generating circuit to end.

* * * * *